US011525221B2

(12) United States Patent
Gibson et al.

(10) Patent No.: US 11,525,221 B2
(45) Date of Patent: Dec. 13, 2022

(54) RAILROAD TIE PLATING MACHINE AND METHOD

(71) Applicant: Appalachian Timber Services, LLC, Sutton, WV (US)

(72) Inventors: Richard A. Gibson, Strange Creek, WV (US); Terry Samples, Spencer, WV (US)

(73) Assignee: Appalachian Timber Services, LLC, Sutton, WV (US)

( * ) Notice: Subject to any disclaimer, the term of this patent is extended or adjusted under 35 U.S.C. 154(b) by 462 days.

(21) Appl. No.: 16/839,587

(22) Filed: Apr. 3, 2020

(65) Prior Publication Data

US 2020/0354898 A1 Nov. 12, 2020

Related U.S. Application Data

(60) Provisional application No. 62/844,788, filed on May 8, 2019.

(51) Int. Cl.
*E01B 9/10* (2006.01)
*E01B 9/40* (2006.01)

(52) U.S. Cl.
CPC ..... *E01B 9/10* (2013.01); *E01B 9/40* (2013.01); *E01B 2201/04* (2013.01)

(58) Field of Classification Search
CPC ..... E01B 9/10; E01B 9/40; E01B 2201/04; B27F 7/00; B27F 7/15; B27M 3/14
See application file for complete search history.

(56) References Cited

U.S. PATENT DOCUMENTS

| | | | |
|---|---|---|---|
| 3,405,649 | A | 10/1968 | Foxx et al. |
| 3,701,320 | A | 10/1972 | Fearon et al. |
| 3,713,396 | A | 1/1973 | Helmut |
| 3,728,968 | A | 4/1973 | Rymes |
| 3,783,773 | A | 1/1974 | Willard et al. |
| 3,943,858 | A | 3/1976 | Dieringer et al. |
| 4,178,671 | A | 12/1979 | Luttig |
| 4,280,613 | A | 7/1981 | Stewart |
| 4,691,639 | A | 9/1987 | Holley |
| 4,911,599 | A | 3/1990 | Theurer et al. |
| 4,942,822 | A | 7/1990 | Cotic |
| 4,974,518 | A | 12/1990 | Cotic et al. |
| 5,191,838 | A | 3/1993 | Hansen |
| 5,331,899 | A | 7/1994 | Holley |
| 5,343,606 | A | 9/1994 | Girouard et al. |
| 5,415,087 | A | 5/1995 | Sniffen et al. |
| 5,528,807 | A | 6/1996 | Girouard et al. |
| 5,617,795 | A | 4/1997 | Glonski et al. |
| 5,655,455 | A | 8/1997 | Smith |

(Continued)

*Primary Examiner* — Robert J McCarry, Jr.
(74) *Attorney, Agent, or Firm* — Andrus Intellectual Property Law, LLP

(57) ABSTRACT

A plating system for attaching a pair of tie plates to a wooden railroad tie with screw spikes such that the tie plates are aligned and in gauge. A predrilling system is used to predrill holes in the appropriate position on the railroad tie according to the line end of the tie prior to loading the tie into the plating system. The plating system clamps the railroad tie in registration according to the line end of the tie, and holds the tie plates in the appropriate position while a pair of hydraulic screw-presses turn screw spikes to fasten the tie plates to the railroad tie in gauge, centered and aligned on the railroad tie.

20 Claims, 17 Drawing Sheets

(56) References Cited

U.S. PATENT DOCUMENTS

| | | | | |
|---|---|---|---|---|
| 5,671,679 | A | 9/1997 | Straub et al. | |
| 5,722,325 | A | 3/1998 | Glonski et al. | |
| 5,813,103 | A * | 9/1998 | Girouard, Sr. | B23Q 7/055 29/33 K |
| 6,089,162 | A | 7/2000 | Madison | |
| 6,119,327 | A | 9/2000 | Girouard et al. | |
| 6,131,272 | A | 10/2000 | Girouard et al. | |
| 6,134,775 | A * | 10/2000 | Castillo | B27F 7/155 29/772 |
| 6,292,997 | B1 * | 9/2001 | Ollendick | E01B 29/06 33/651 |
| 6,543,118 | B1 | 4/2003 | Girouard et al. | |
| 6,546,612 | B2 | 4/2003 | Ollendick et al. | |
| 6,681,474 | B2 | 1/2004 | Ollendick et al. | |
| 6,681,977 | B1 | 1/2004 | Matlock | |
| 7,497,166 | B2 | 3/2009 | Fuerst | |
| 8,844,786 | B2 * | 9/2014 | Stackhouse, Jr. | E01B 29/32 227/39 |
| 10,081,917 | B2 | 9/2018 | Irion et al. | |
| 2001/0034933 | A1 | 11/2001 | Ollendick et al. | |
| 2003/0061697 | A1 | 4/2003 | Ollendick et al. | |
| 2016/0153151 | A1 | 6/2016 | Irion | |

* cited by examiner

RAILROAD TIE PLATING MACHINE AND METHOD

FIELD OF THE INVENTION

The invention pertains to the mounting and attachment of tie plates to wooden railroad ties.

BACKGROUND OF THE INVENTION

Tie plates are often made of cast iron or rolled steel and are attached on the top surface of wooden railroad ties to support the rails. A fastening assembly, spikes, or both, are used to mount the rail to the tie plate. The tie plate has a rail seat into which the rail sits when mounted in the field. Collars and holes are often provided on both sides of the rail seat to enable clips and spikes to secure the rails to the tie plate. Exemplary tie plate 10A, 10B are shown on a railroad tie 12 in FIGS. 3-7.

The tie plate 10A, 10B increases the bearing area and holds the rail 16A, 16B to correct gauge, or distance between the rails. In the modern railroad industry, gauge is 56.5 inches measured from inside rail to inside rail. The part of the tie plate under the rail base is called the rail seat and is angled slightly, setting the cant of the rail an inward rotation from the vertical. The usual slope is 1.4 degrees. The top surface of the tie plate also has shoulders that fit against the edges of the base of the rail. The shoulders and the canted channel bottom form the rail seat.

It is important that the tie plates be mounted on the railroad tie at the correct spacing and correct distance from the line end of the railroad tie in order for the rails to be at gauge when laid. It is also important that the tie plates be mounted straight and centered on the railroad tie and that the cant of the seat be sloping inward when the rail is laid. If the tie plates are not mounted correctly, or if the rail falls out of gauge through use, adjustments must be made in the field to maintain gauge. It is an object of this invention to reduce errors when mounting tie plates and to also reduce maintenance by mounting the tie plates within a closer tolerance than is currently required in the railroad industry.

Tie plates are typically attached to the wooden railroad ties with common spikes or with screw spikes. The present invention pertains to attaching tie plates to railroad ties with screw spikes. An exemplary screw spike 14 is shown in FIG. 5. The screw spike 14 has a square head to facilitate attachment with an air gun or pneumatic ratchet. One-half inch holes are typically drilled in the top surface of the wooden railroad tie 12 for the screw spikes 14. Tie plates are sometimes attached in the field, but it is often desirable to supply pre-plated railroad ties to the job site.

The process involves placing the tie plates over holes drilled in the railroad tie. Predrilled railroad ties are typically supplied to the field. As mentioned, it is important that the tie plates be placed so that the cant slants inward. The worker then sets the screw spikes one at a time through the screw holes in the tie plate into the respective drilled hole using a sledge. The object is to set the screw spike straight, but this is difficult to do on a reliable basis. Errors in gauge can occur if the screw spike is not set vertically. An air gun ratchet is used by the worker to screw in the screw spike after it is set. The worker tries to keep the socket centered over the drilled hole, but this is difficult to achieve for a number or reasons including that the air gun typically weighs about 80-100 pounds. If the worker does not keep the socket vertically over the hole, or if the screw spike is set crooked, the tie plate can move out of position when it is being attached, which may cause it to fall out of gauge. In addition, the screw hole can get bored out or stripped if the worker does not stop the air gun in a timely manner after the screw spike if fully secure. Needless to say, when hand fastening with an air gun, it is difficult to be reliably accurate even if screw holes are accurately predrilled.

SUMMARY OF THE INVENTION

The invention pertains to a method of attaching a pair of tie plates to a wooden railroad tie with screw spikes. Use of the method results in tie plates being reliably aligned and in gauge. The method attaches the tie plates to tighter dimensional tolerances than is typical with previous attachment methods. The first step in the method is to provide a railroad tie with screw holes predrilled into the top surface of the railroad tie. The predrilled railroad tie is conveyed into a plating system, for example using a gravity fed conveying system and a kicker to load the railroad tie onto rollers that convey the railroad tie into the plating system lengthwise. The plating system has two plate attachment stations: one for each tie plate that is being attached to the top surface of the railroad tie. Each plate attachment station has a holding press with a foot that holds the respective tie plate reliably in place on the predrilled railroad tie. Each plate attachment station also has a screw press to hold and fasten screw spikes to attach each tie plate while it is being held in place by the foot on the respective holding press. An actuation mechanism, such as a hydraulic cylinder and mechanical linkage, lifts and lowers each holding press and its foot.

Once the predrilled railroad tie is conveyed to the plating system, its line end is aligned in registration with a reference position, for example by abutting the line end against an end stop. The screw holes are previously drilled at locations in registration with the line end as is discussed in more detail below. Then, the predrilled railroad tie is clamped in the registered position such that a top surface of the predrilled railroad tie lies substantially in a horizontal plane. At this point in the method, the first and the second tie plates are placed on the top surface of the predrilled railroad tie, and are held securely in place against the top surface of the predrilled railroad ties with the foot of the holding press in the respective plate attachment station. More specifically, the first and second tie plates are held in registration along the aligned, clamped railroad tie by the press feet so that rails mounted in the tie plates will be in gauge. Preferably, the clamping step involves the use of two self-centering clamps that clamp the lateral sides of the railroad tie and an end clamp that pushes against the end of the railroad tie opposite its line end when the line end is abutting the end stop. The self-centering clamps are useful to keep the tie plates centered on the railroad tie even if the width of the tie varies. As discussed, the railroad tie is clamped in a similar fashion when predrilling the screw holes. Desirably, each foot pushes downward on the respective tie plate with a significant amount of force, and keeps the tie plate centered on the railroad tie, positioned at the proper distance from the line end along the length of the railroad tie and orientated straight. The tips of the screw spikes are then placed through the screw holes in the tie plates and into the predrilled holes and the heads of the screw spikes are placed in the respective sockets on the screw presses. While the railroad tie is aligned and clamped and the first and second tie plates are held against the top surface of the railroad tie with the respective press foot, the screw press in each plate attachment station screws the screw spikes and fasten the tie plates to the top surface of the drilled railroad tie. By virtue of the design, the sockets on the screw presses remain vertically aligned with the screw holes in the ties plates and the holes drilled in the top surface of the railroad tie. In addition, the press feet hold the plates in the correct position and orientation on the railroad tie while the screw spikes are being fastened.

The plating system can include an optional staging plate at each station for holding a tie plate before the holding press in the plate attachment station picks up the tie plate and places it on the aligned and clamped, predrilled railroad tie. The staging plate has upstanding reference pins to that fit into designated screw holes or other physical reference openings in the tie plate so that the tie plate is accurately aligned and orientated when the tie plates are lifted from the staging plate.

In an especially desirable embodiment, the holding press in each plate attachment stations is equipped with an electromagnet that is controlled to engage and release the tie plate as required for lifting. The electromagnet is located on the holding press above and adjacent the foot. Each press foot is preferably made of steel and is configured to nest within the seat or rail channel of the tie plate between a field side shoulder and an inside shoulder. The foot on each holding press is canted to complement the cant of the rail seat of the tie plate that it is configured to lift, move and hold. In use, each holding press is moved over a tie plate placed on the respective staging plate and pressed down so that the canted foot nests in the seat of the tie plate. Then, the electromagnet is activated to magnetically pull the tie plate against the foot. The holding press is lifted and moved into place on the aligned and clamped railroad tie with the tie plate placed in precise alignment on the top surface of the railroad tie by the press foot.

Each screw press includes multiple screw heads, for example four (4) screw sockets. The screw press includes a rotational actuator for each screw head and a linear actuator for lifting and lowering a mounting plate to which the screw heads and rotational actuators are mounted. In the preferred embodiment, the actuators are hydraulically powered, and the hydraulic pumps are controlled by a control system. In each plate attachment station, the tie plate is held in place by the respective press foot and the screw press is lowered to a height appropriate for loading the screw spikes. Loading the screw spikes is preferably done by hand by placing the tip of the screw spike through an appropriate screw hole in the tie plate and into the predrilled hole, and by loading the head of the screw spike into the appropriate socket. When all the screw spikes are loaded, the actuators are activated to screw the screw spikes and fasten the tie plates. A sensor detects when the socket assemblies in the first and second plate attachment stations have moved downward to a pre-selected depth and generates a signal in response thereto. The rotation of the respective screw sockets in the station is deactivated when the signal is received in order to avoid overtightening. The screw press is then lifted to remove the sockets from the heads of the screw spikes. The finished product is then released from the clamps and is transported from the plate attachment stations, ready for shipping to the job site.

The railroad ties are desirably predrilled in a predrilling system having a conveyor that moves in an x-direction. The railroad tie is placed on the conveyor with its length generally perpendicular to the x-direction and its line end facing a predetermined side. The railroad tie is conveyed to a drilling station and is lifted from the conveyor. The line end of the lifted railroad tie is aligned in registration to a reference position in a y-direction which is parallel to the x-direction, for example by pushing the line end against an end stop. The lifted railroad tie is clamped after it is aligned along the line end. Desirably, it is clamped laterally on each end with self-centering clamps and along the end to hold the line end against the end stop. The clamping for predrilling is desirably the same as for fastening the screw spikes. Then, screw holes are drilled in the top surface of the railroad tie for both tie plates while the railroad tie is clamped in the registered position in the drilling station.

The plating system and the predrill system can be configured to drill the holes and screw the screw spikes in pre-selected positions for a specific type and size of tie plate. On the other hand, the drill press and the screw press can be adjustable or reconfigurable. In this case, it is important that the positions of the drill bits and screw sockets be set to be on center with the pre-selected positions for a specific type and size of tie plate. This can be accomplished effectively using set-up templates for the specific tie plates being attached to the railroad ties. For each tie plate, there is a template for positioning the screw heads or sockets and a template for positioning the drill bits. Preferably, the templates are metal plates with holes positioned for the screw sockets and drill bits on center to the appropriate positioning for drilling and screwing in relation to the line end of the railroad tie. The preferred templates also include an indicator designating the line side of the template.

In another aspect, the invention is embodied in a plating system configured to implement the above described method in varying degrees of detail.

DETAILED DESCRIPTION

Figure 1:
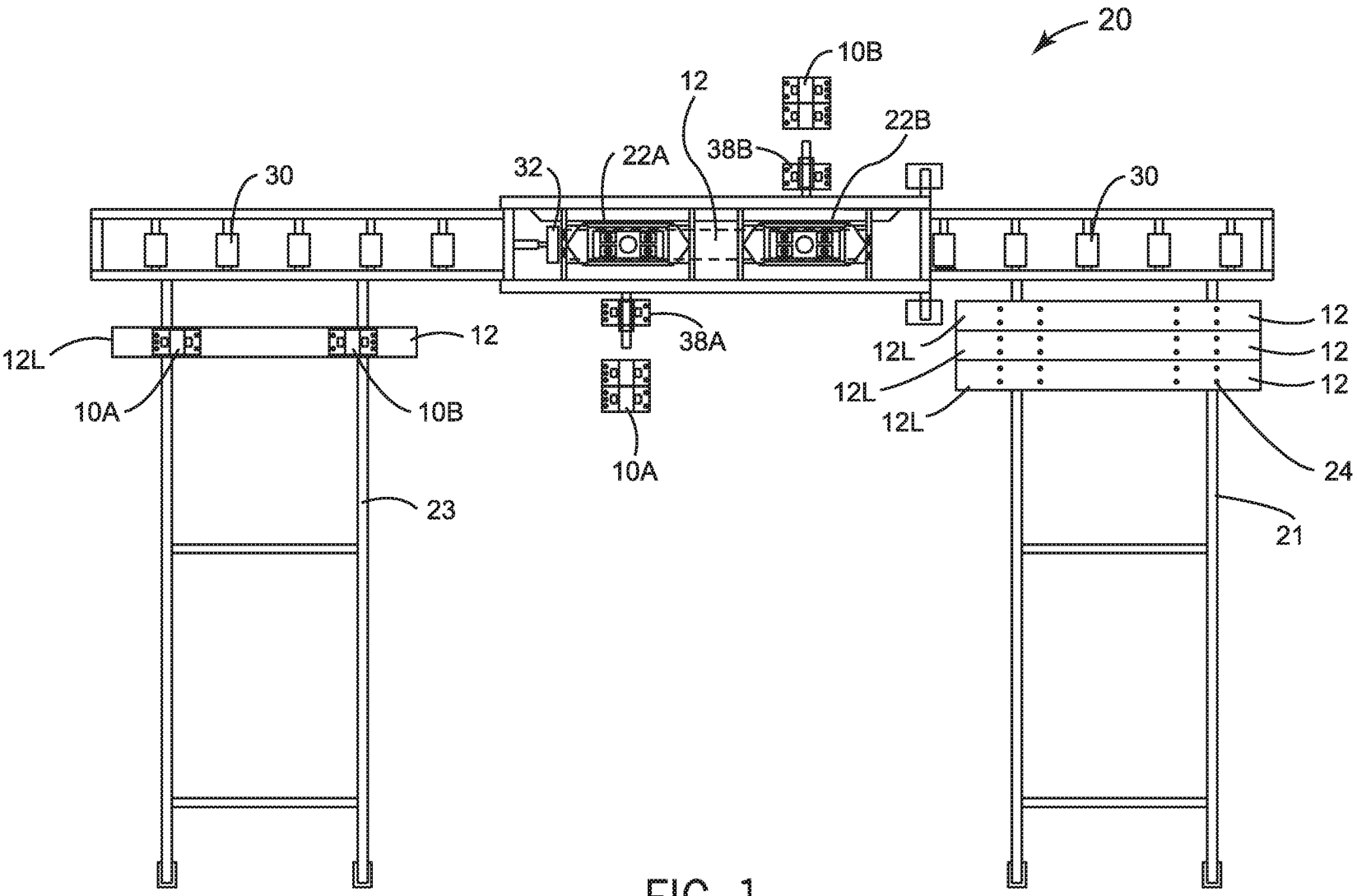
FIG. 1 is an overview of a plating system constructed in accordance with an exemplary embodiment of the invention.
Figure 2:
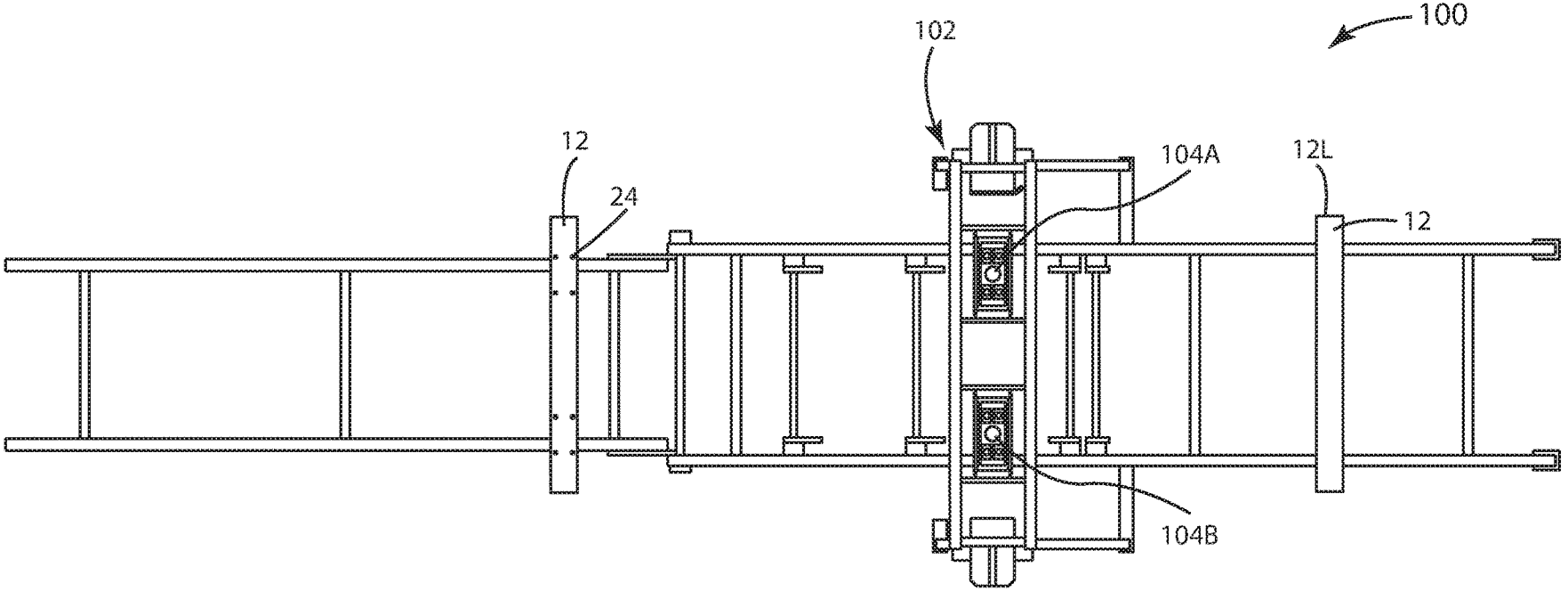
FIG. 2 is an overview of a predrilling system constructed in accordance with an exemplary embodiment of the invention.
Figure 3:
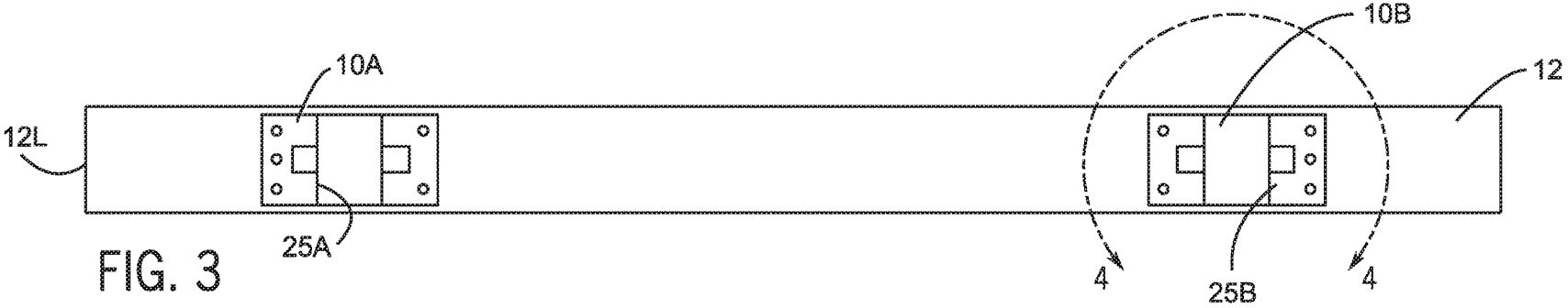
FIG. 3 is a top view of an exemplary railroad tie with attached tie plates.
Figure 5:
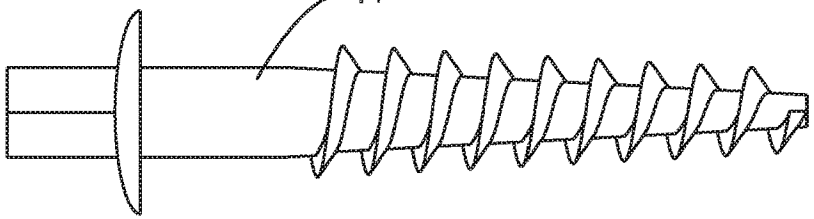
FIG. 5 shows an exemplary screw spike.

FIG. 1 illustrates a plating system 20 that is configured to attach tie plates 10A, 10B to a predrilled railroad tie 12 in accordance with an exemplary embodiment of the invention. FIG. 2 illustrates a predrilling system 100 designed to drill screw holes 24 in the railroad tie 12 prior to attaching the tie plates 10A, 10B.

Figure 4:
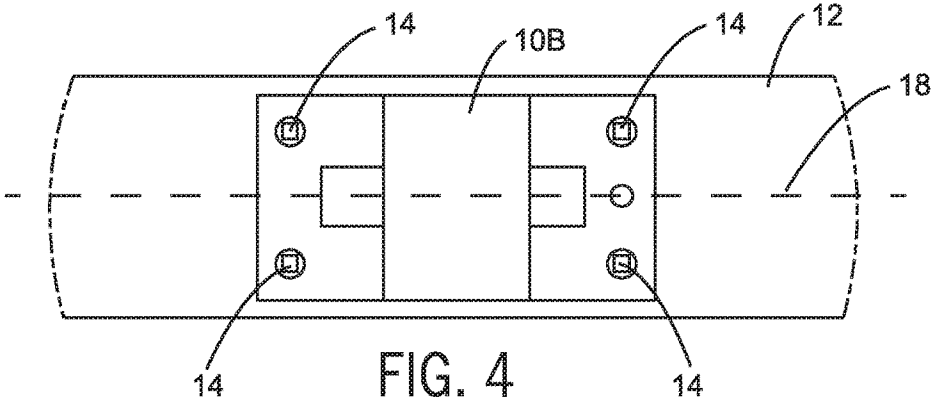
FIG. 4 is a detail view of the region depicted by dotted line 4-4 in FIG. 3.

Referring first to FIGS. 3 through 7, the finished product from the plating system 20 is a railroad tie 12 with tie plates 10A, 10B attached to its top surface with screw spikes 14. The tie plates 10A, 10B are attached in registration to the line end 12L of the railroad tie 12 and are mounted so that rails 16A, 16B are in gauge with reference to the line end 12L when the rails 16A, 16B are mounted in the tie plates 10A, 10B. The railroad ties 12, as mentioned, will have predrilled holes 24 (FIG. 2) and will have been treated with a preservative such as creosote. Typically, the wood ties 12 will be treated prior to predrilling the holes 24. The tie plates 10A, 10B shown in the exemplary embodiments are Pandrol® Victor plates and the width of the railroad ties 12 is 6" within tolerances. The invention can be implemented with railroad ties having different widths and using different tie plates; however, the purpose of the invention to attach the tie plates 10A, 10B to the top surface of the railroad tie 12 with screw spikes 14. As mentioned, gauge in the US is 56.5" measured from the inside rail 16A to the inside rail 16B, see FIG. 6. In the embodiment depicted in FIG. 3 with Pandrol® Victor plates, the distance from the line end to the field shoulder 25A for tie plate 10A is 18.5" and the distance between the field shoulder 25A for tie plate 10A and the field shoulder 25B for tie plate 10B should be 65.6875". Given the configuration of the tie plates 10A, 10B, these dimensions result in the distance between rails 16A, 16B in FIG. 6 being 56.5"+/−the tolerance. In addition to being set a fixed distance from the line end 12L and being spaced apart a fixed distance from one another, the tie plates 10A, 10B also need to lie flat on the top surface of the railroad tie 12, be centered across the width of the railroad tie 12, and also properly aligned so that the rail sits nicely in the seat of the tie plate. The width of a given railroad tie will often vary from end to end even though this variance is not desirable. Yet, it is important that the tie plates 10A, 10B be centered across the width of the railroad tie 12. FIG. 4 shows tie plate 10B properly centered across the width of the tie plate. In FIG. 4, the tie plate 10B is placed symmetrically along the longitudinal center line of the top surface of the railroad tie 12 (although in the field or during production the center line 18 is not designated or identified on the top surface of the railroad tie 12).

Figure 6:
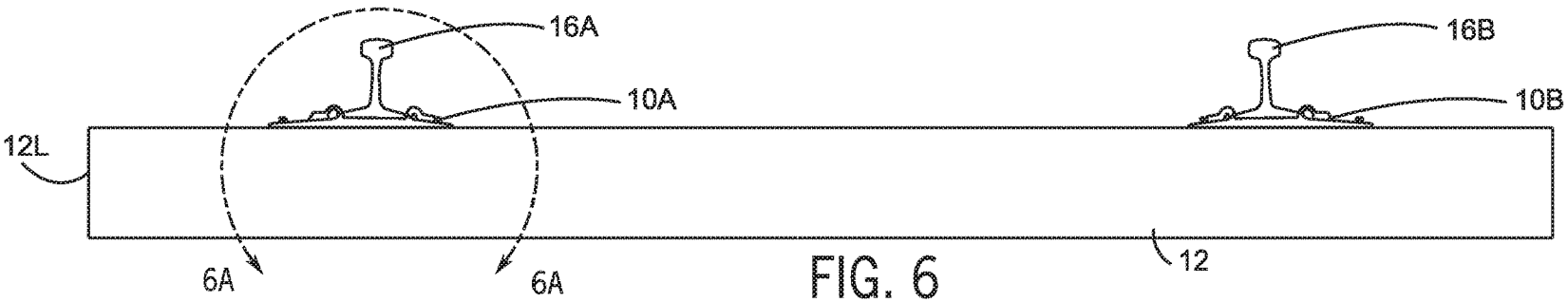
FIG. 6 is a side elevational view of the railroad tie with tie plates shown in FIG. 4, also showing rails mounted in the attached tie plates.
Figure 6A:
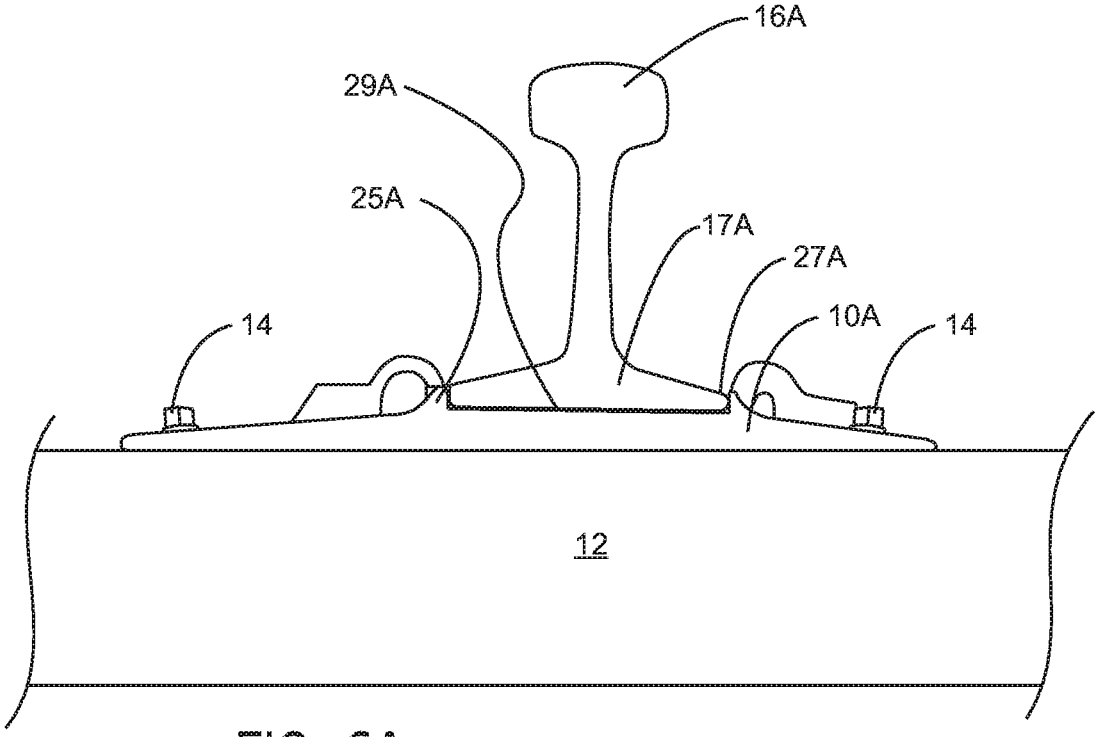
FIG. 6A is a detail view of the region depicted by dotted line 6A-6A in FIG. 6.

Referring to FIG. 6A, tie plate 10A is shown mounted to the railroad tie 12 with a rail 16A then mounted in the tie plate 10A, as it will be in the field. The tie plate 10A includes a field side shoulder 12A and an inside shoulder 27A. A canted channel bottom 29A extends between the shoulders 25A and 27A. The shoulders 25A, 27A and the channel bottom 29A form a seat for the base 17A of the railroad tie 16A. The seat is designed so that the rail 16A fits securely within the seat and is tilted inward towards the other rail, for example at a slope of 1.4°. As mentioned, it is important that the tie plate 10A be mounted with the cant properly facing inward. As shown in FIG. 4, the plates 10A, 10B have an additional hole on the field side of the plate 10A, 10B which is not typically used for attaching the tie plate 10A, 10B to the railroad tie 12, but is helpful for conveniently identifying the field side of the tie plate 10, 10B.

Figure 7:
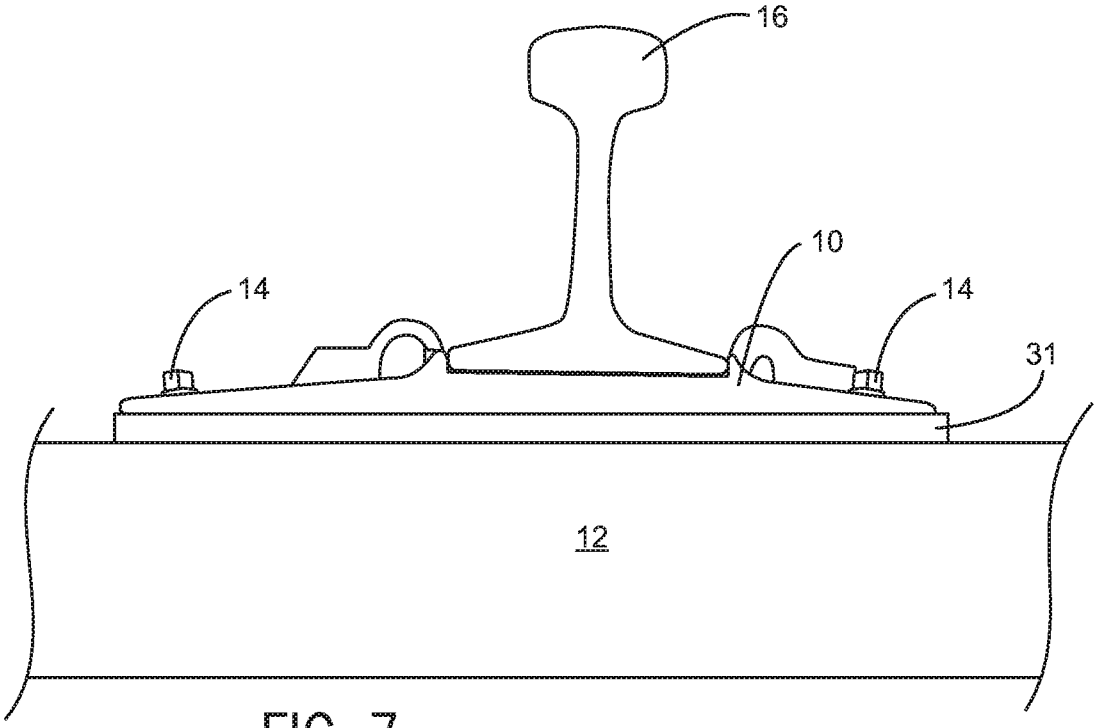
FIG. 7 is a view similar to FIG. 6A showing the use of an optional elastomeric pad when mounting the tie plate to the railroad tie.

The invention is used to reliably attach the tie plates 10A, 10B to the railroad ties 12 as shown in FIGS. 3 through 6, 6A. It can also be used as shown in FIG. 7 to attach tie plates 10 to the railroad tie 12 with an optional elastomeric pad 31 placed between the tie plate 10 and the railroad tie 12. These elastomeric pads 31 are used in some applications to dampen vibrations. The inventive method is described herein primarily with respect to attaching the tie plates 10A, 10B directly to the top surface of the railroad tie 12, but it should be understood that the method can be modified to include the use of the optional elastomeric pad 31 as well.

Referring now to FIG. 1, predrilled railroad ties 12 are loaded onto a gravity feed conveyor 21. The predrilled railroad ties 12 are loaded with the lines end 12L on the left of the feed conveyor 21. The line side 12L of the predrilled railroad ties 12 is marked as is common in the art. The predrilled railroad ties 12 are loaded onto the conveyor 30 for the plating system 20, which comprises powered rollers to move the loaded predrilled railroad tie 12 lengthwise into a first and second plate attachment station 22A, 22B. After the tie plates 10A and 10B are attached, the powered rollers 30 move the railroad tie 12 to a gravity-fed output conveyor 23 as a finished product. FIG. 1 also shows in phantom a railroad tie loaded into the first and second plate attachment stations 22A, 22B. An end stop 32 is shown on the downstream side of the plate attachment stations 22A, 22B. The line end 12L of the railroad tie 12 is pushed against the end stop 32 to register the longitudinal position of the railroad tie 12. The end stop 32 is mounted to a hydraulic lift so that it can be raised to allow the railroad tie 12 to be conveyed away from the plate attachment stations 22A, 22B after the tie plates 10A, 10B have been attached. A hydraulic end clamp (not shown) pushes against the other end of the railroad tie 12 to hold the railroad tie 12 and the line end 12L against the end stop 32.

Once the railroad tie 12 is loaded into the first and second plate attachment stations 22A, 22B, it is first lifted, and then it is clamped. Self-centering clamps 36A, 36B (not shown in FIG. 1) clamp the lateral sides of the railroad tie 12, so that the railroad tie is centered within the first and second plate attachment stations 22A, 22B. Each plate attachment station 22A, 22B includes a staging plate 38A, 38B. An operator places tie plates 10A, 10B on the respective staging plate 38A, 38B to ready the system 20 for attaching the plates 10A, 10B to the railroad tie 12. Reference numbers 10A, 10B in FIG. 1 refer to stacks of tie plates 10A, 10B waiting to be loaded by the operator on the respective staging plate 38A, 38B. Each plate attachment station 22A, 22B includes a holding press 40, see FIGS. 13A-13B, and a screw press 42, see FIG. 11.

Figure 13A:
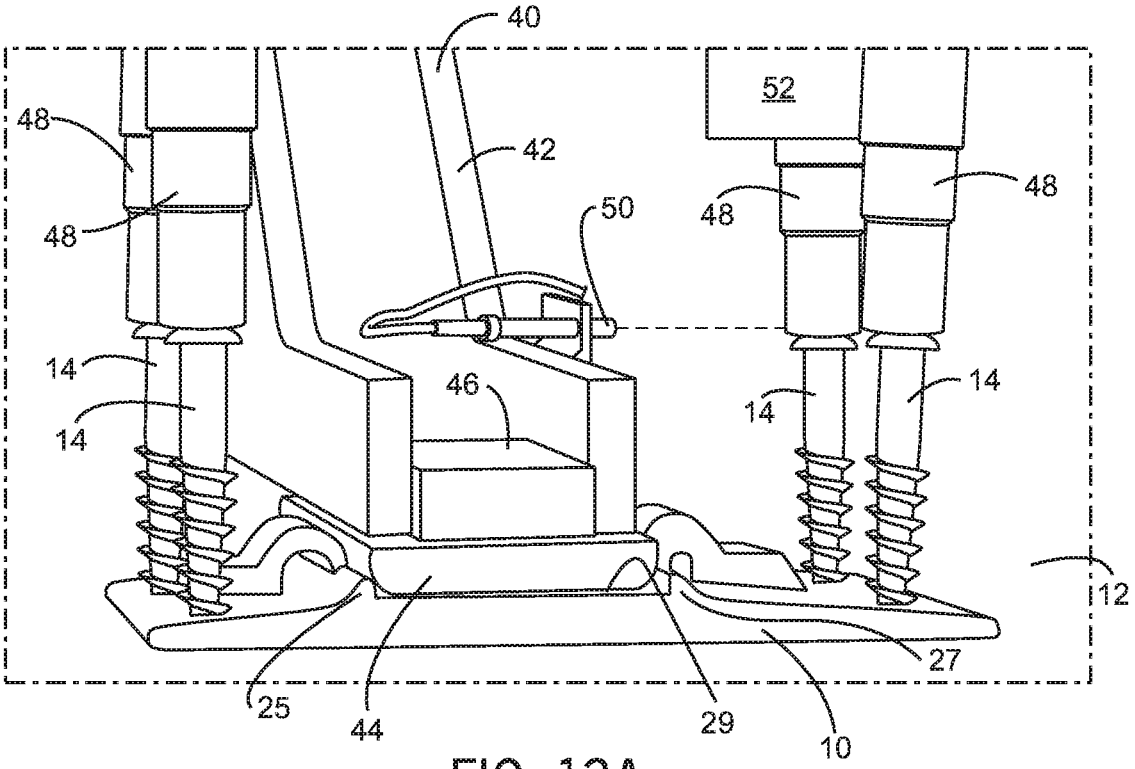
FIGS. 13A and 13B illustrate an exemplary holding press being used to hold a tie plate in registration on a clamped railroad tie when screw spikes are loaded into the heads of the screw press and then turned to fasten the tie plate to the railroad tie.
Figure 13B:
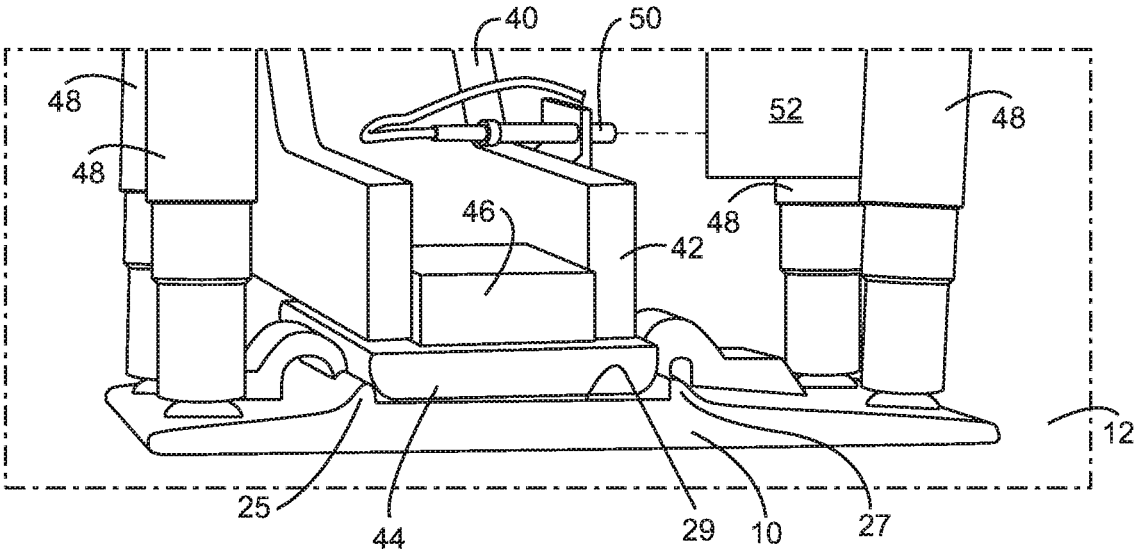

Referring to FIGS. 13A and 13B, the holding press 40 includes a main arm 42 that is lifted vertically and moved horizontally by hydraulically controlled motors (not shown in FIGS. 13A and 13B). A foot 44 is mounted to the bottom of each press arm 42. Each foot 44 is made for example from steel, and is configured to nest within the seat of the tie plate 10. More specifically, the foot 44 nests between the shoulders 25, 27 of the seat, and also lies flat against the bottom wall 29 of the seat. The bottom wall 29 is canted towards the inside of the tie, and accordingly the bottom of the foot 44 is likewise canted so that it complements and fits flat along the canted bottom wall 29 of the seat of the tie plate 10. Each holding press 40 also includes an electromagnet 46. A control system activates the electromagnet 46 to lift and release the tie plate 10 as required. The lifting and releasing of the tie plates is shown in more detail with respect to FIGS. 15A through 15J. Briefly, the holding press 40 is lowered over a tie plate 10 located on the respective staging plate 38 such that the foot 44 nests within the seat of the tie plate. Then, the electromagnet 46 is activated to pull the tie plate 10 against the press foot 44, and the arm 42 of the holding press 40 is lifted and moved over the railroad tie 12. At this point in the process, the railroad tie 12 is lifted and clamped in a registered position within the first and second plate attachment stations 22A, 22B. The arm 42 of the holding press 40 is then lowered so that the tie plate 10 is pressed against the top surface of the railroad tie 12 in the registered position. The holding press 40 continues to hold the tie plate 10 in the registered position against the top surface of the railroad tie 12 while the screw spikes 14 are set in place as shown in FIG. 13A and also while the screw heads 48 are turned to fasten the tie plate to the railroad tie 12. The continued holding of the tie plate 10 in the registered position while fastening the tie plate 10 to the railroad tie 12 is important to ensure that the tie plate 10 does not move during the fastening process. FIGS. 13A and 13B also show a sensor 50 that detects when the screw heads 48 have lowered to an appropriate distance for complete tightening of the screw spikes 14 without over-tightening. The sensor 50 provides a signal to the control system to stop rotation of the screw heads 48 when the appropriate height is detected. The control system also stops the screw presses from lowering at the appropriate time. In FIGS. 13A and 13B, the sensor 50 is a proximity sensor which senses the presence of an enlarged collar 52 on one of the screw heads 48.

Figure 11:
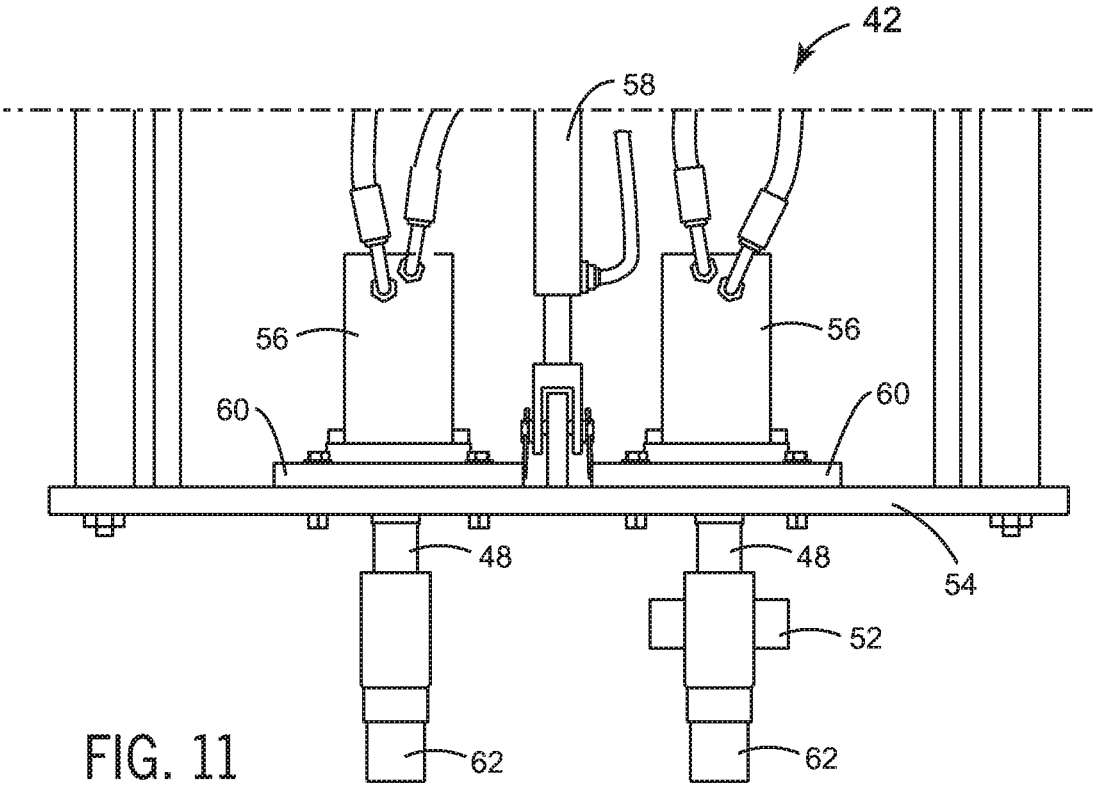
FIG. 11 is a side elevational view of a screw press constructed in accordance with an exemplary embodiment of the invention.

Each plate attachment station 22A, 22B includes a screw press 42 as shown in FIG. 11. Referring now to FIG. 11, the screw press 42 in each plate attachment station 22A, 22B includes multiple screw heads 48, preferably four (4), as shown in FIGS. 13A and 13B for example. The screw heads 48 are turned by hydraulically powered, rotational actuators 56 that are mounted to adjustable plates 60 attached to a base plate 54. A hydraulic lifting cylinder 58 is connected to the base plate 54 to raise and lower the base plate 54 and the screw heads 48. Each of the screw heads 48 includes a socket 62 that is configured to fit the square head of the screw spikes 14. The sockets 62 can be lifted relative to the other components of the screw head 48 in order to facilitate loading of the square head of the screw spikes 14, when the screw press 42 is lowered to a position for loading the screw spikes 14 prior to activating the rotational actuators 56 and the linear actuator 58 to turn and lower the screw spikes 14 into the railroad tie 12.

Figure 12:
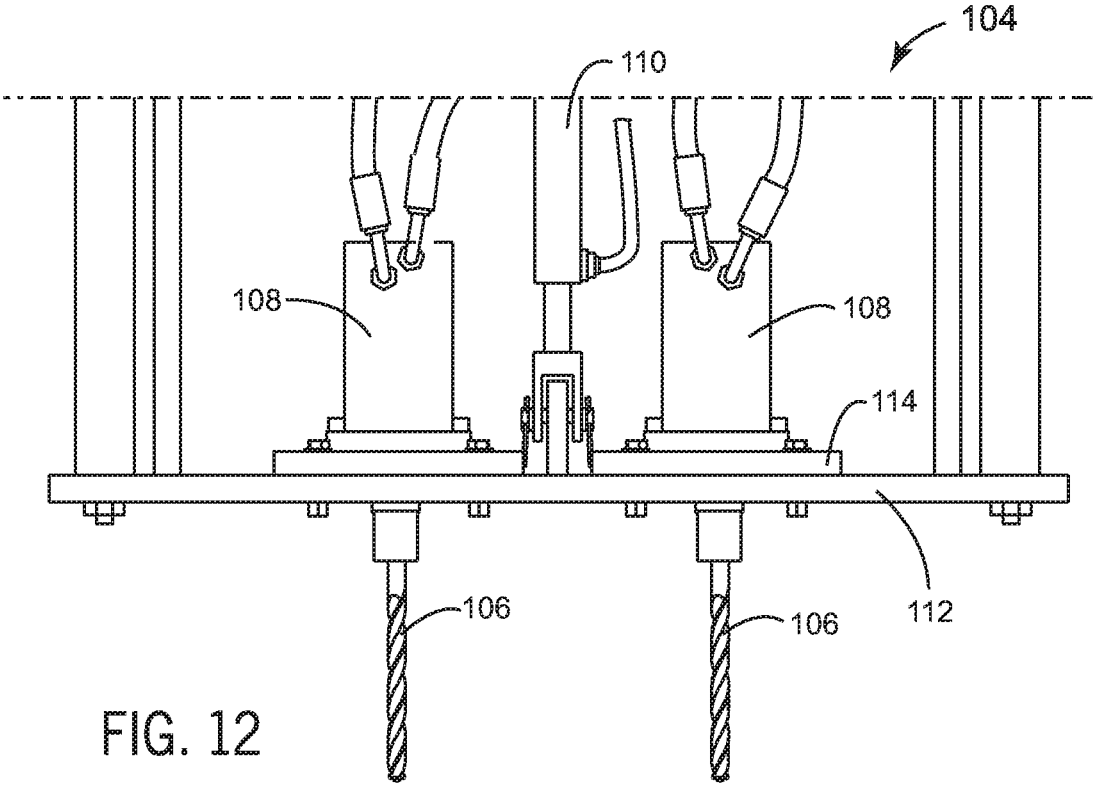
FIG. 12 is a side elevational view of a drill press constructed in accordance with an exemplary embodiment of the invention.

Now referring to FIGS. 2 and 12, the predrilling system 100 includes a drilling station 102 that has a first drill press 104A and a second drill press 104B. In FIG. 2, railroad ties 12 are conveyed from right to left. When the railroad tie 12 is conveyed into the drilling station 102, it is lifted and clamped with the line end 12L pushed against an end stop (not shown in FIG. 2) to register the position of the railroad tie 12 in the drilling station 102. The drilling station 102 also has self-centering clamps to clamp the railroad tie 12 laterally in a similar fashion as is done in the plating system 20. Each drill press 104A, 104B includes four (4) one-half inch drill bits. Referring to FIG. 12, the drill bits 106 are driven by rotational hydraulic actuators 108. Each drill press 104 is raised and lowered using a hydraulic linear actuator 110 that is connected to a base plate 112 for the drill press. The rotational actuators 108 are mounted to adjustable plates 114 which in turn are attached to the base plate 112. In accordance with the invention, the positioning of the drill bits 106 is on center with the holes in the tie plate 10 being attached to the railroad tie 12 and also on center with the screw heads 48 and sockets 62. It should be understood that similar hydraulic actuators can be used for the screw presses 42 and the drill presses 104. Referring again to FIG. 2, once the screw holes 24 are drilled in the top surface of the railroad tie 12, the clamping is released and the tie 12 is lowered and conveyed from the drilling station 102. At this point the railroad tie 12 is ready for loading into the plating system 20.

Figure 8:
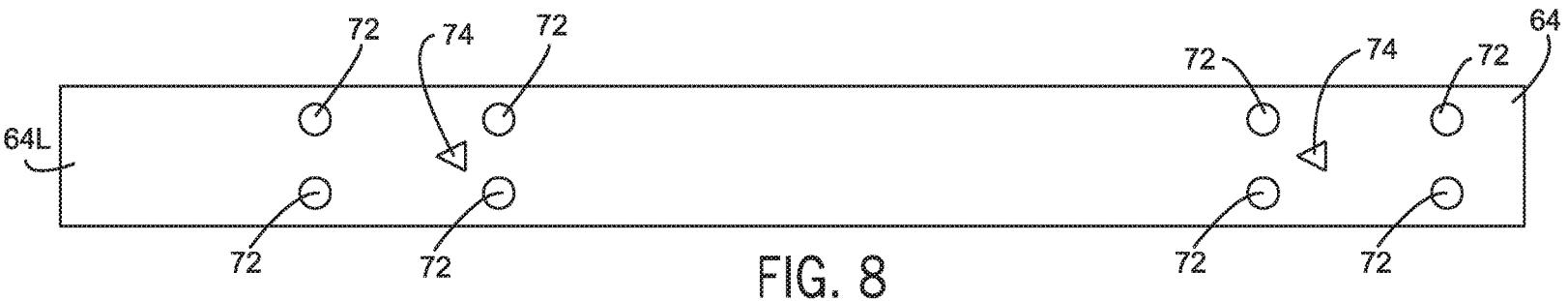
FIG. 8 is a template used to set up a screw presses in the plating system.
Figure 9:
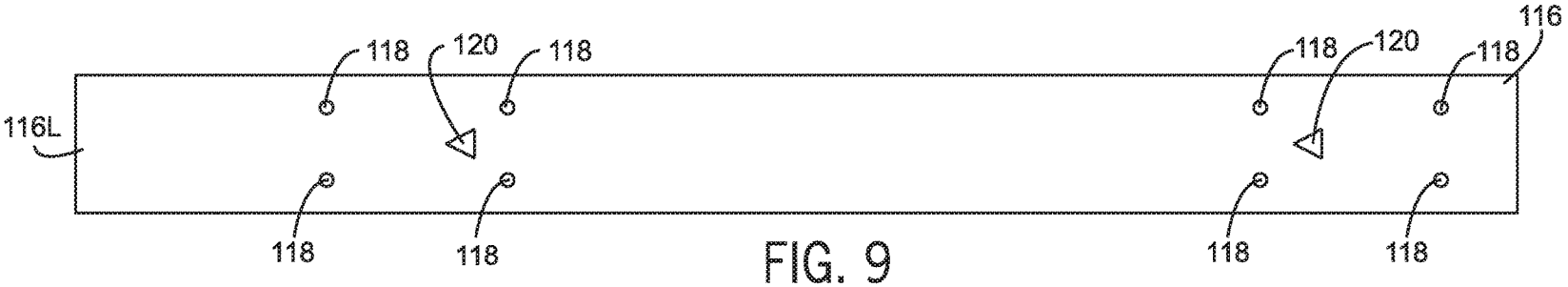
FIG. 9 is a template used to set up the drill presses in the predrilling system.
Figure 10:
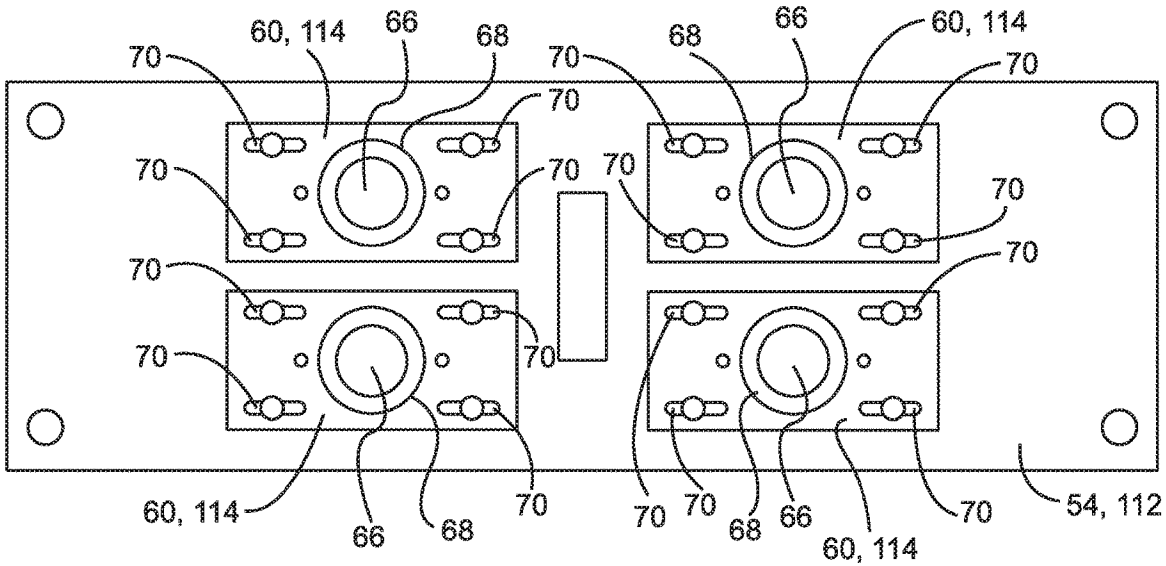
FIG. 10 shows mounting components for the screw presses and drilling presses that enable the position of the drill bits and the screw heads to be adjusted.

It is desirable that the drill presses 104 and the screw presses 42 be reconfigurable so that the equipment can be used to attach tie plates 10 having screw holes in different positions than other tie plates. With this concept in mind, FIG. 10 shows a top view of the base plates 54, 112 that are used in the screw presses 42 and the drill presses 104. Adjustable plates 60, 114 are attached to the base plates 54, 112. The adjustable plates 60, 114 are designed with an opening 66 and an annular shoulder 68 to hold the respective rotational actuator 56, 108 on center on the respective adjustable plate 60, 114. The adjustable plates 60, 114 also have slots 70 to enable the position of the adjustable plate 60, 114 to be adjusted with respect to the base plate 54, 112. The slots 70 shown in FIG. 10 allow the plates 60, 114 to move laterally in FIG. 10, although the concept could be applied to repositioning in other directions if desired. Of course, it is imperative that the screw holes 24 in the top surface of the predrilled railroad tie 12 be in line with the screw holes in the respective tie plates 10A, 10B, in line with the screw heads 48 in the respective plate attachment stations 22A, 22B, and also in registration with the line end 12L of the railroad tie 12. To help accomplish this task, a metal template 64 as shown in FIG. 8 can be used to set the position of the screw heads 48 in both the first and second plate attachment stations 22A, 22B. The size of the round openings 72 in the metal template 64 is selected to fit over the collars of the sockets 62 on the screw heads 48. The triangular openings 74 point to the line end 64L of the template 64. The position of the circular holes 72 is selected with respect to the line end 64L so that the screw heads 48 are on center with the desired location for the screw holes in the railroad tie 12. The adjustable plates 60 in the drill presses 42 are adjusted so that the sockets 62 fit in the openings 72 with the template 64 held in registration against the end stop or another suitable reference point, and then the adjustable plates 60 are tightened in place to the base plate 54. Similarly, FIG. 9 shows a metal template 116 for the drill bits 106 in the drill presses 104. The circular openings 118 are sized to fit around the diameter of the drill bits 106. The triangular openings 120 point towards the line end 116L of the template 116. The adjustable plates 114 are moved until the drill bits 106 pass through the round openings 118 when the line end 116L is held in registration against the end stop (or other suitable reference point). Then, the adjustable plates 114 are tightened against the base plate 112. In this manner, the drill bits 106 and the screw sockets 62 are appropriately located in registration for the appropriate tie plates.

Figure 14A:
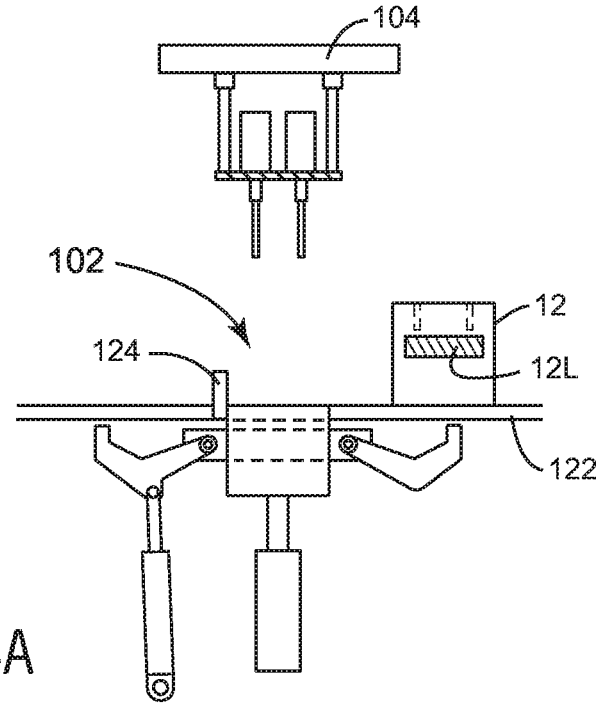
FIGS. 14A through 14H illustrates steps involved when predrilling screw holes in a top surface of the railroad tie in accordance with an exemplary embodiment of the invention.
Figure 14B:
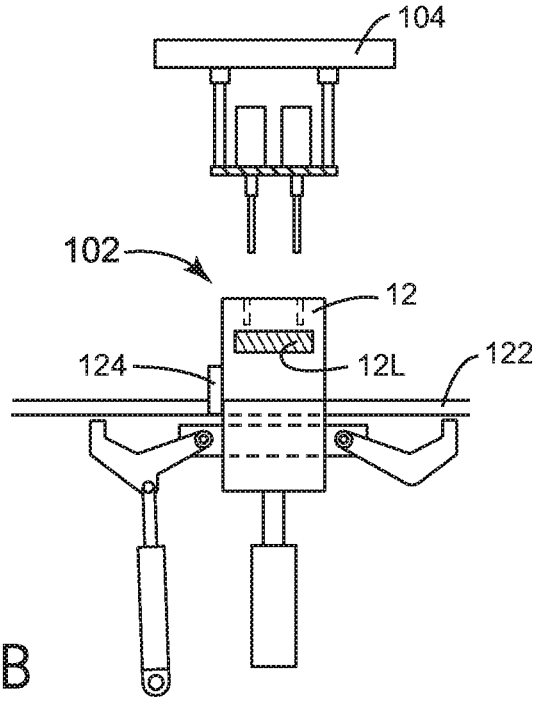
Figure 14C:
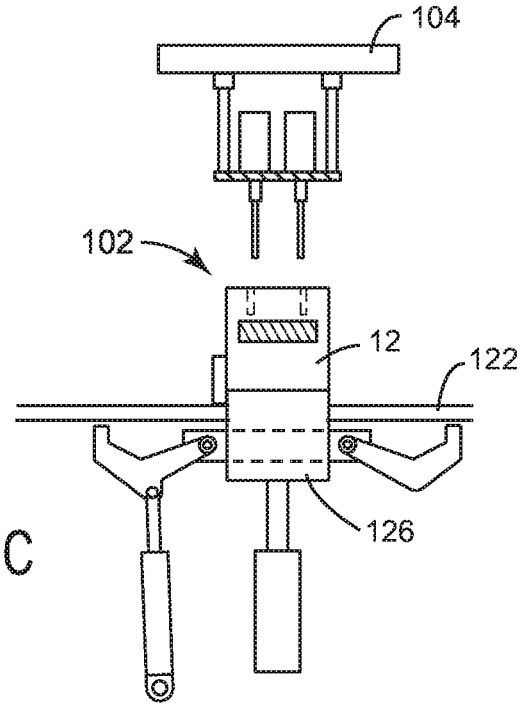
Figure 14D:
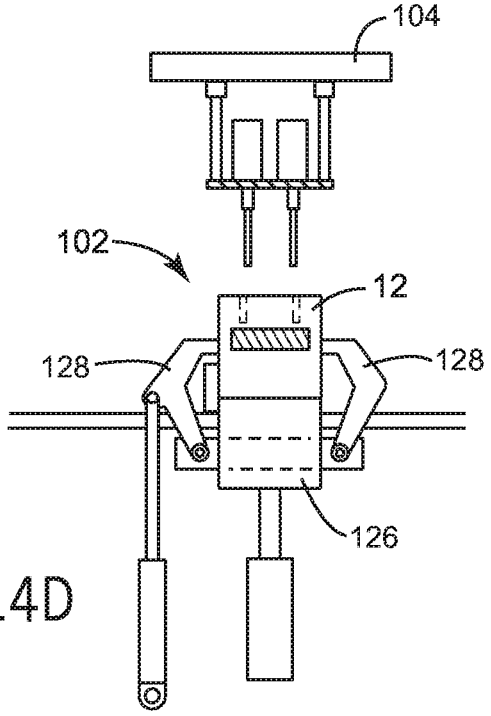

The preferred steps for predrilling holes 24 in the railroad ties 12 are now discussed in relation to schematic FIGS. 14A through 14H. FIGS. 14A through 14D illustrate the operation of the drilling station 102 with reference to components on one side of the drilling station, Reference characters without the designation A or B are used to generally refer to similar components in each side of the drilling station 102. In FIG. 14A, the railroad tie 12 is being conveyed on a conveyor 122 towards the drilling station 102. The line end 12L of the tie 12 is marked and is set on a predetermined side. The railroad tie 12 is conveyed crosswise into the drilling station 102 until it hits a stop 124. The stop 124 is desirably movable between an up position and a down position and is actuated in response to a motion sensor recognizing that a railroad tie 12 is moving into the drilling station 102. FIG. 14B shows the railroad tie 12 located in the drilling station 102 and abutting the raised stop 124. FIG. 14C shows the railroad tie 12 being lifted upward off the conveyer 122. More, specifically, FIG. 14C shows a hydraulic lift 126 lifting one end of the railroad tie 12 for purposes of illustration; however, it should be understood that another hydraulic lift 126 is provided to lift the other end of the railroad tie. The railroad tie 12 is lifted so that its top surface remains horizontal. FIG. 14D shows the next step in the process in which the lifted railroad tie 12 is clamped with hydraulic, self-centering clamps 128. The clamp arms 128 clamp against the lateral side of the railroad tie 12. Again, for purposes of illustration, FIG. 14D shows a set of lateral clamps 128 near one side of the railroad tie 12, but it should be understood that similar clamps are located on the other side of the railroad tie 12. In this manner, the self-centering clamps 128 center both sides of the railroad tie 12, which is important for drilling the holes 24 on center when the width dimensions of the railroad tie vary.

Figure 14E:
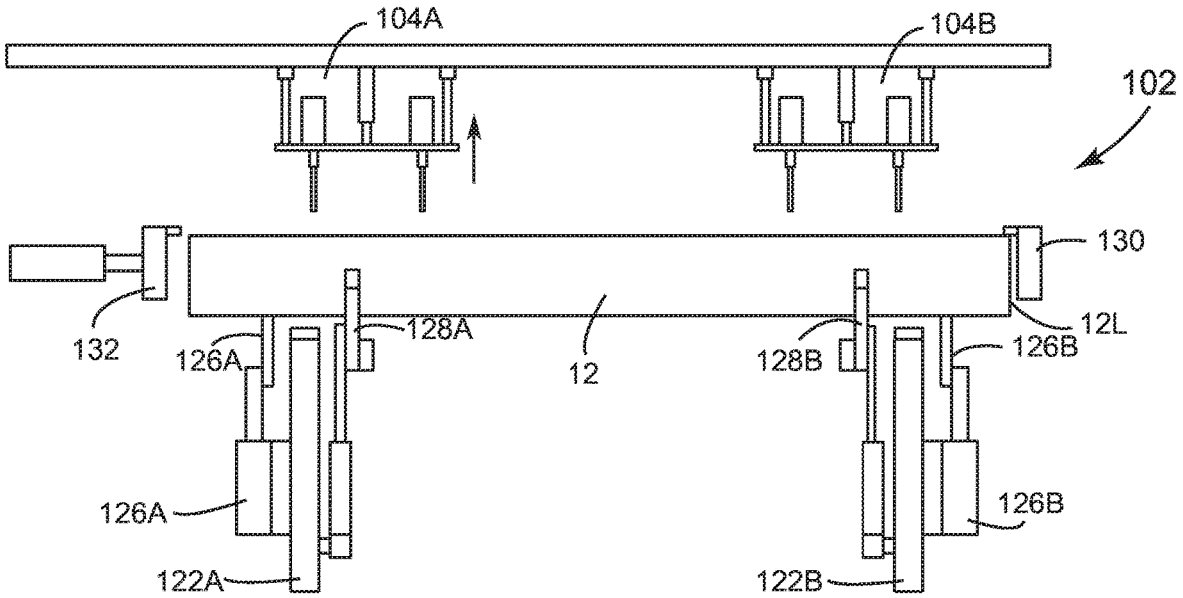
Figure 14F:
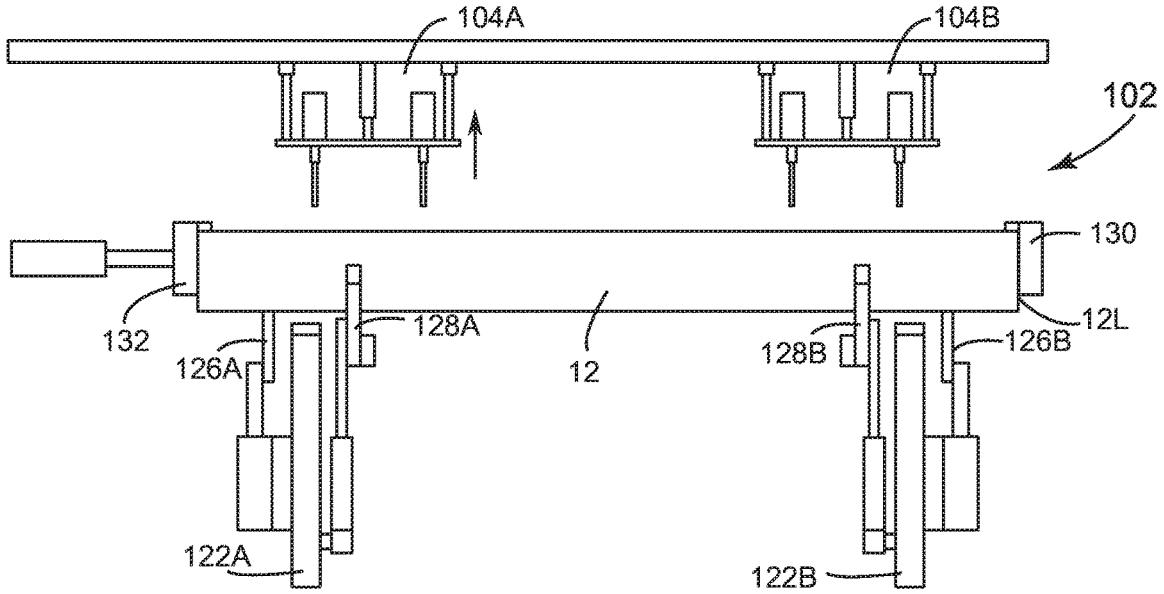

FIG. 14E shows the railroad tie 12 in the drilling station 102 as viewed from the input conveyor. In FIG. 14E, the lift on each side 126A, 126B have lifted the railroad tie 12 above the conveyors 122A, 122B. In addition, the self-centering clamps 128A, 128B have clamped the lateral sides of the railroad tie 12. The line end 12L of the railroad tie 12 has not yet been pushed against, or to be in registration with, the end stop 130. The hydraulic push arm 132 on the opposite side of the end stop 130 is used to push the tie 12 against the end stop 130. The drill presses 104A, 104B remain in the up position at this stage in the process. FIG. 14F shows the next step in the process after which the lifted railroad tie 12 has been pushed with the actuator arm 132 so that the line end 12L of the tie is pressed against the end stop 130. In FIG. 14F, the drill presses 104A and 104B remain in the up position.

Figure 14G:
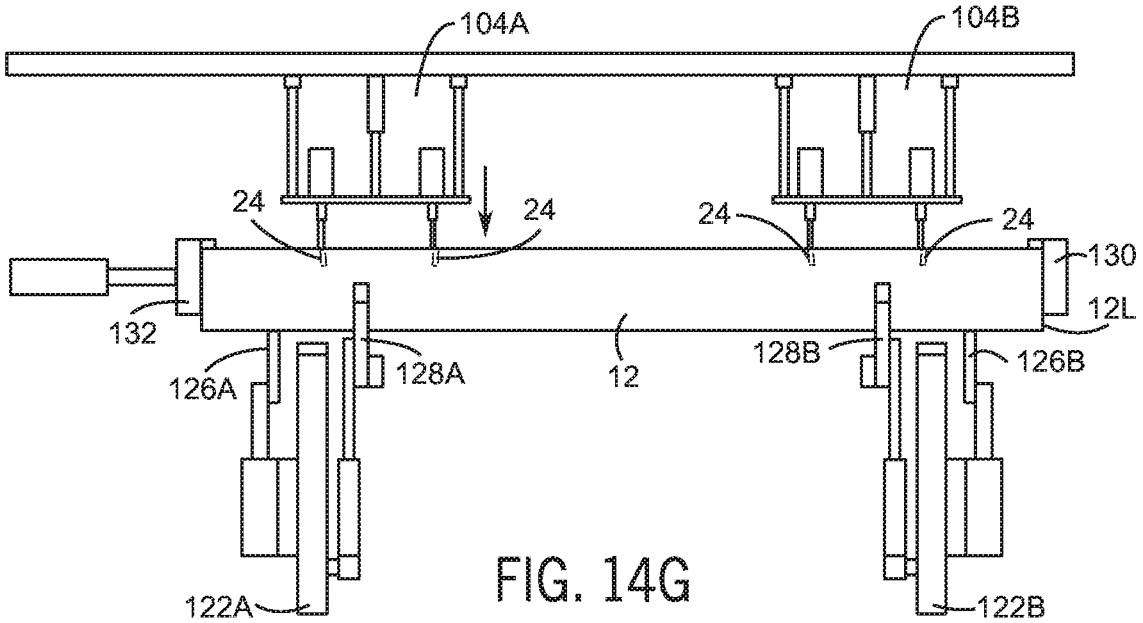
Figure 14H:
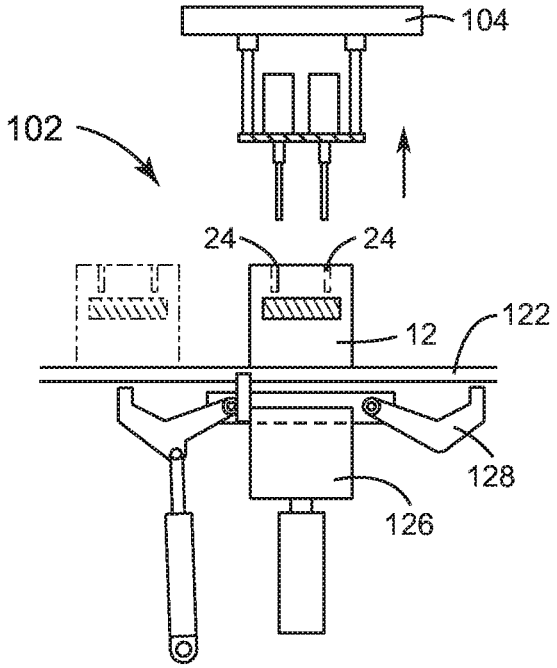

With the railroad tie 12 lifted and clamped to be on-center and in registration against the end stop 130, the drill presses 104A, 104B are lowered to drill holes 24 in the top surface of the railroad tie 12 as shown in FIG. 14G. FIG. 14H shows the next step in the process in which the drill presses 104 are lifted, the clamps 128 are opened, the push actuator 132 is retracted, and the lifts 126 are lowered to set the railroad tie 12 with predrilled holes 24 on the conveyor 122 for transport downstream from the drilling station 102.

Figure 15A:
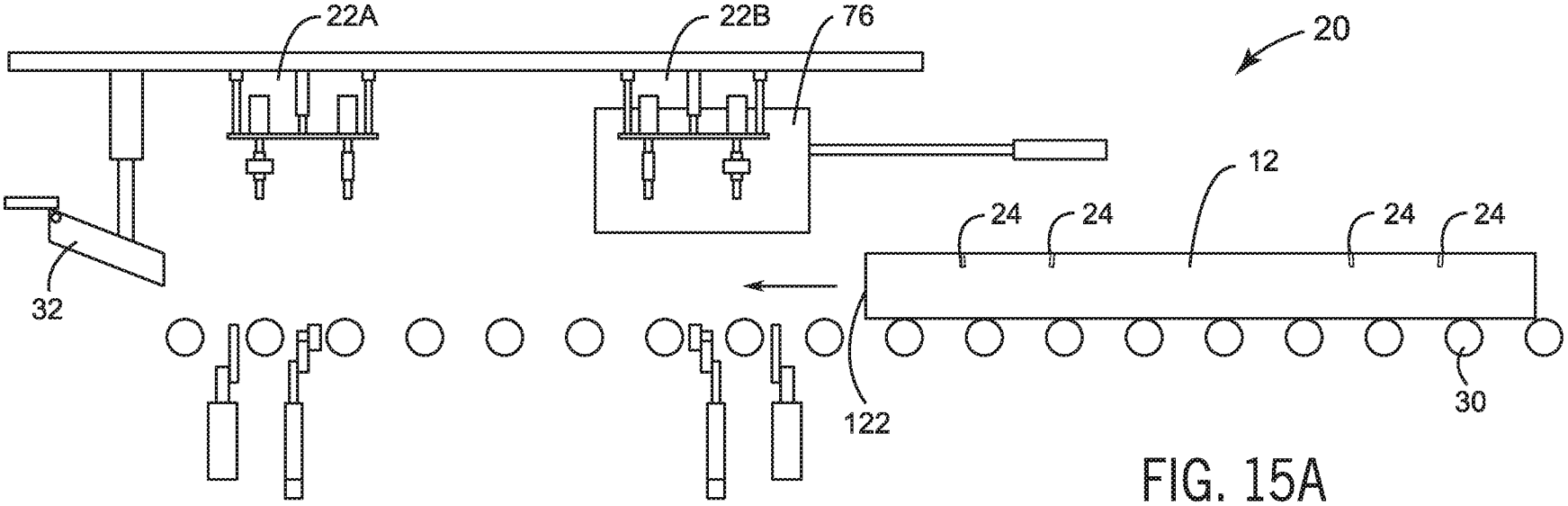
FIGS. 15A through 15K illustrates steps involved when attaching tie plates to a top surface of a predrilled, railroad tie in the plating station constructed according to the exemplary embodiment of the invention.
Figure 15B:
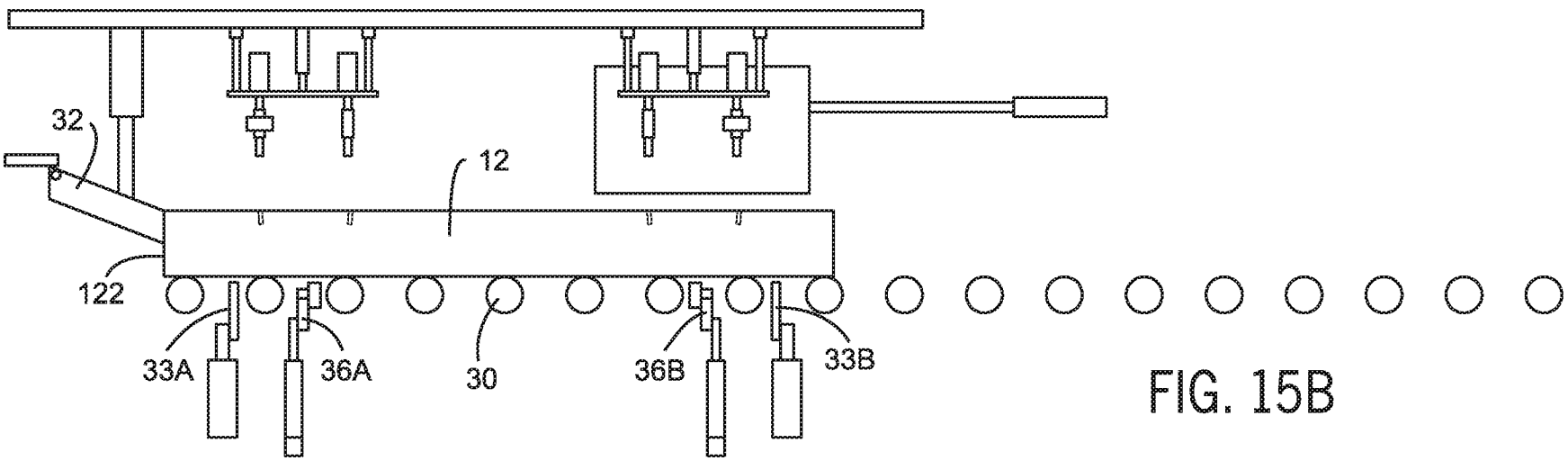
Figure 15C:
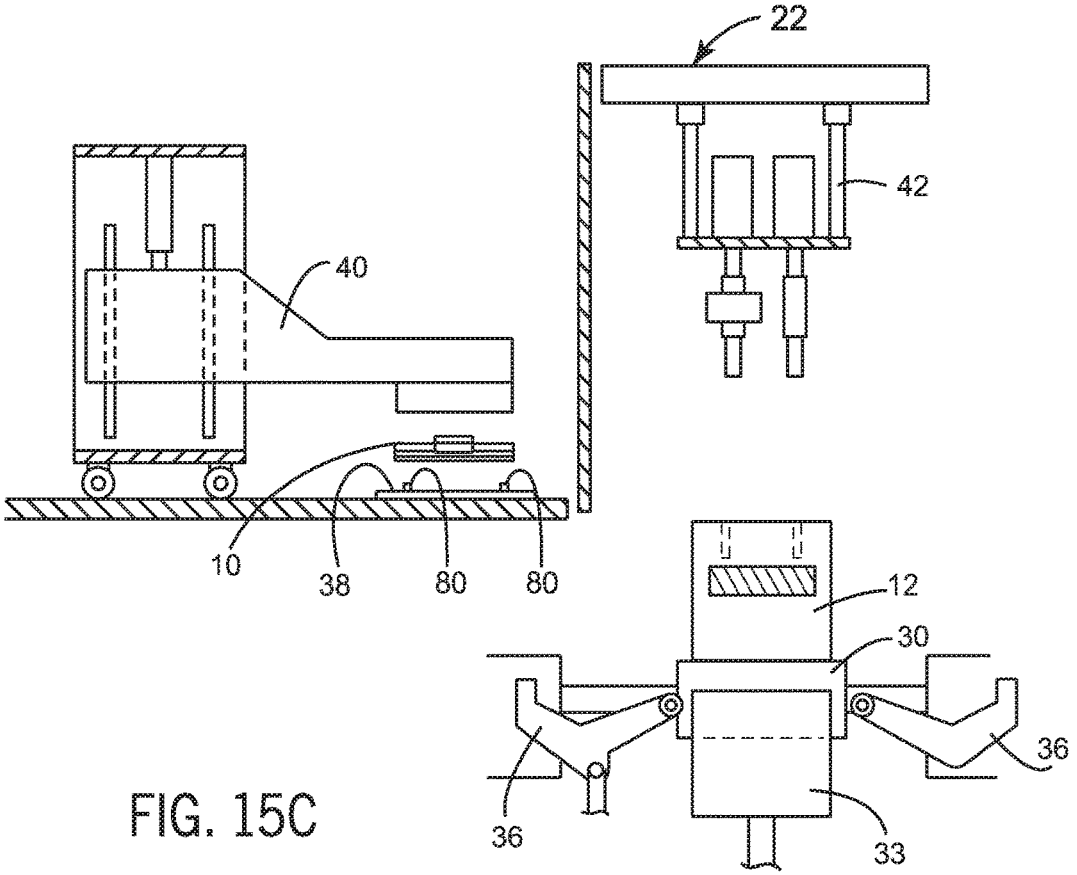
Figure 15D:
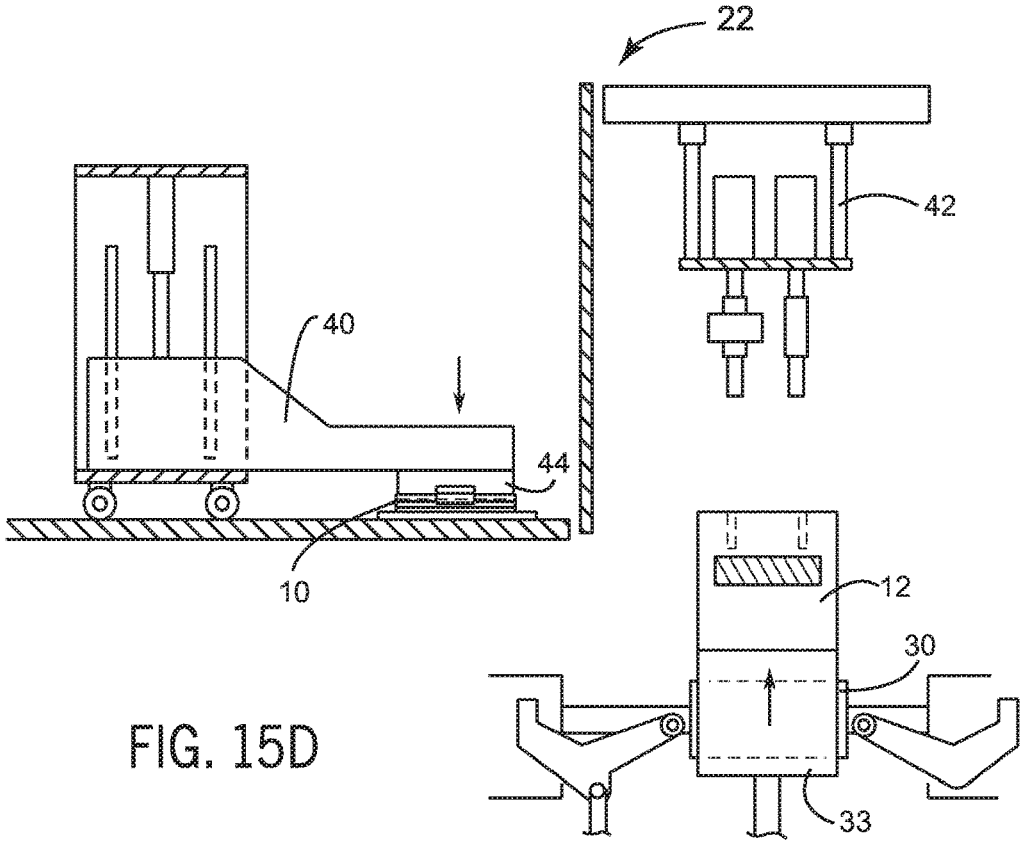

FIGS. 15A through 15J schematically depict the steps involved in attaching tie plates 10A, 10B to a railroad tie 12 using the plating system 12 described in FIG. 1. FIGS. 15C through 15F, and 15J, illustrate the operation of the both the first and second plate attachment stations 22A, 22B. Reference characters without the designation A or B are used to generally refer to similar components in each plate attachment station. In FIG. 15A, the railroad tie 12 with predrilled holes 24 is loaded onto rollers 30 which are driven to load the railroad tie 12 into the system 20 lengthwise. FIG. 15A shows a hydraulically actuated safety shield 76 preventing access by an operator to the second plate attachment station 22B while the railroad tie 12 is being loaded. A similar hydraulically actuated safety shield 76 is also present in the system 20 for the first plate attachment station 22A but is not shown because it would block visualization of components behind the safety shield. FIG. 15B shows the railroad tie 12 being loaded into the system 20 with the line end 12L being stopped by the end stop 32. The end stop 32 is hydraulically actuated so that it can be raised and lowered, as explained previously in order to allow the railroad tie 12 to exit the system once the tie plates 10A, 10B have been attached. A sensor detects when the railroad tie 12 is roughly in position shown in FIG. 15B, and in response hydraulic lifts 33A, 33B are actuated to lift the railroad tie 12 above the rollers 30. The driven rollers are also desirable deactivated. FIG. 15C shows the railroad tie 12 on the rollers 30 as depicted in FIG. 15B but from a different viewpoint. FIG. 15D shows the hydraulic lift 33 being actuated to lift the railroad tie 12 above the rollers 30. For purposes of illustration, FIG. 15D shows on one lift 33, however as shown in FIG. 15B a lift 33A, 33B is provided at each end of the railroad tie 12. The railroad tie 12 is lifted so that its top surface remains horizontal.

FIGS. 15C and 15D also schematically illustrate a screw press 42 for the plate attachment station 22 and a holding press 40 for the plate attachment station 22. In FIG. 15C, a tie plate 10 is being placed on the staging plate 38. The staging plate 38 includes reference pins 80 that extend upward and are designed to fit into the screw holes or other holes in the tie plate 10 in order to ensure that the tie plate 10 is in the proper position and the orientation on the staging plate 38. FIG. 15D shows the holding press 40 moving downward so that the foot of the press engages the channel or the seat of the tie plate 10. At this step in the process, the electromagnet 46 is also actuated to pull the tie plate 10 against the foot 44 of the holding press 40.

Figure 15E:
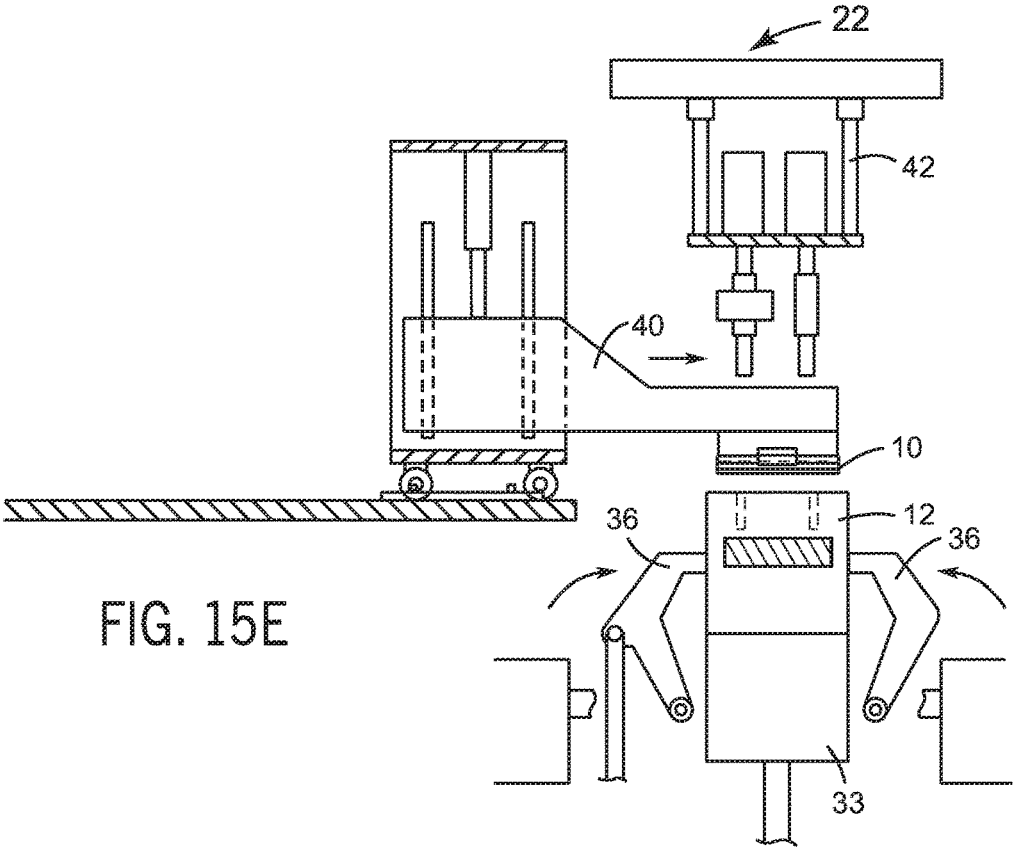
Figure 15F:
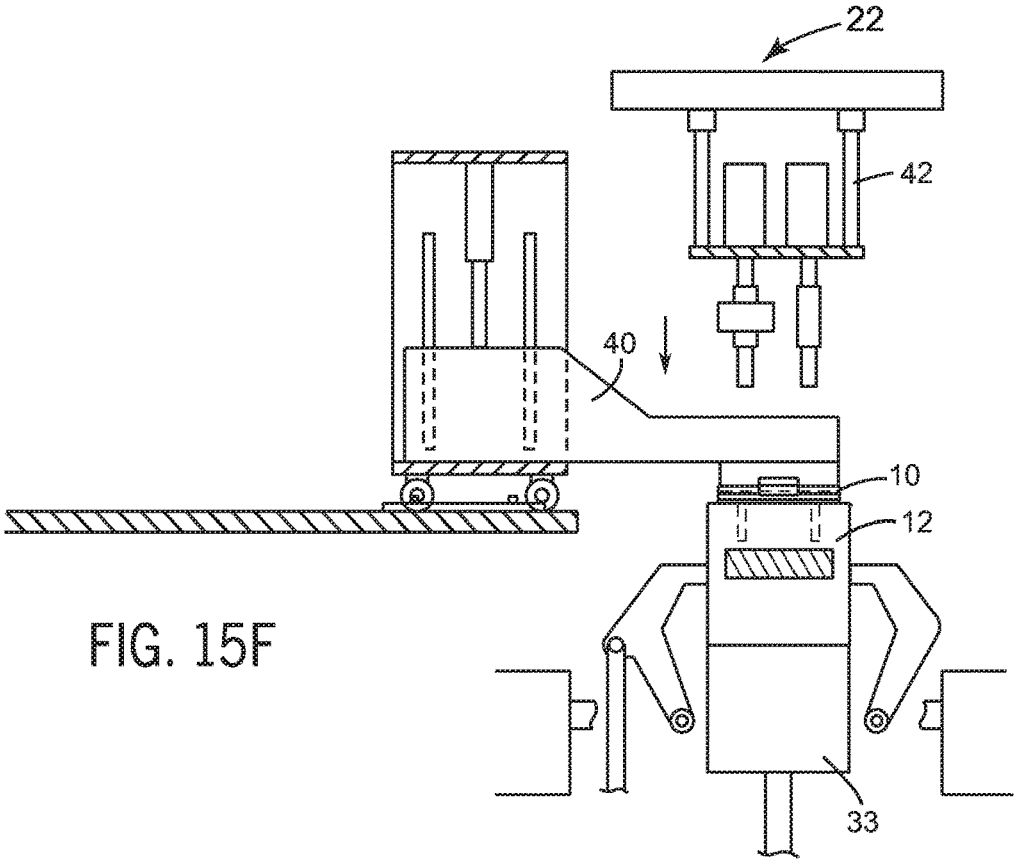

FIG. 15E shows the lifted railroad tie 12 being clamped with the self-centering clamps 36. As shown for example in FIG. 15B, there is a set of self-centering clamps 36A, 36B at each end of the railroad tie 12. The self-centering clamps 36 are desirably of the same construction as those used in the drilling system 100, and serve to center the railroad tie 12 longitudinally even if it does not have a consistent width. At the same time, a hydraulic actuator arm (not shown) pushes the line end 12L of the rail against the end stop 32. Referring again to FIG. 15E, while the lifted railroad tie 12 is being clamped, the holding press 40 moves the tie plate 10 into position over the railroad tie 12 beneath the respective screw press 42. FIG. 15F shows the next step in the process in which the holding press 40 moves downward to press the tie plate 10 against the top surface of the lifted and clamped railroad tie 12. As described previously, the feet 44 of the respective holding presses 40 hold the ties 10A, 10B in precise registration with the designated position along the railroad tie in reference to the line end of the railroad tie.

Figure 15G:
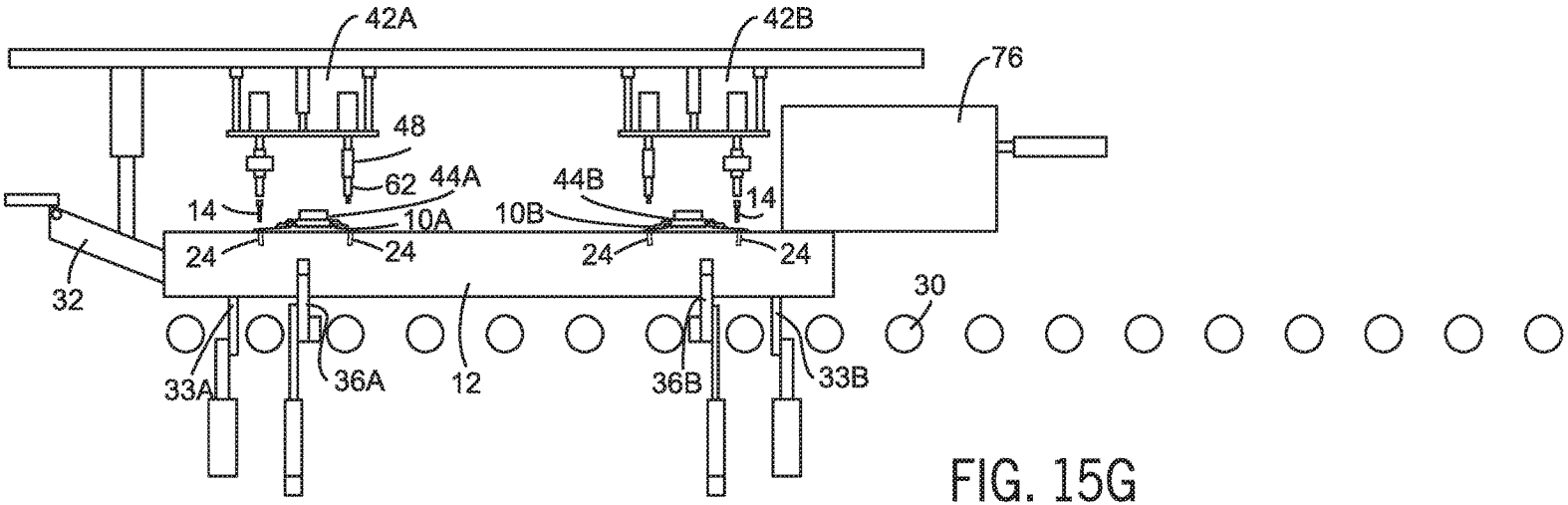
Figure 15H:
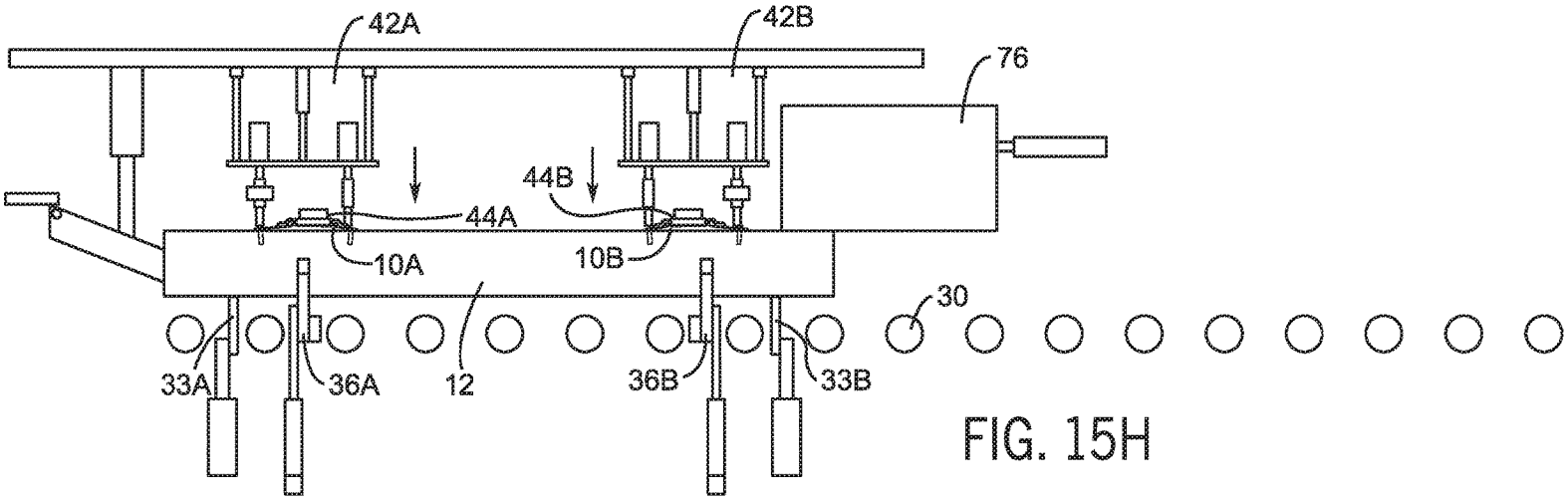

In FIG. 15G, the respective feet 44A, 44B of the holding presses are shown holding down the tie plates 10A, 10B against the top surface of the railroad tie 12. The safety shield 76 is retracted and the operators load the screw spikes 14. This is done by putting the tip of the screw spike 14 through the screw holes in the tie plate and into the predrilled holes 24 in the top surface of the railroad tie 12. The top square head of the screw spikes 14 is placed in the sockets 62 of the respective screw heads 48. FIG. 15H shows the next in the process in which the screw presses 42A, 42B are activated to be lowered and to also turn the sockets 62 in order to screw the screw spikes 14 into the railroad tie 12 and fasten the tie plates 10A, 10B. FIG. 15H shows the safety shield 76 remaining in the open position during this step of the process although it may be more desirable to close the shield 76 for this step in the process. It is noted that the screw spikes 14 are maintained in vertical alignment by the respective screw presses 42A, 42B when being screwed into the railroad tie 12 to fasten the tie plates 10A, 10B. It is also noted that the feet 44A, 44B continue to hold the tie plates 10A, 10B in place while the screw spikes 14 are being screwed into the railroad tie 12.

Figure 15I:
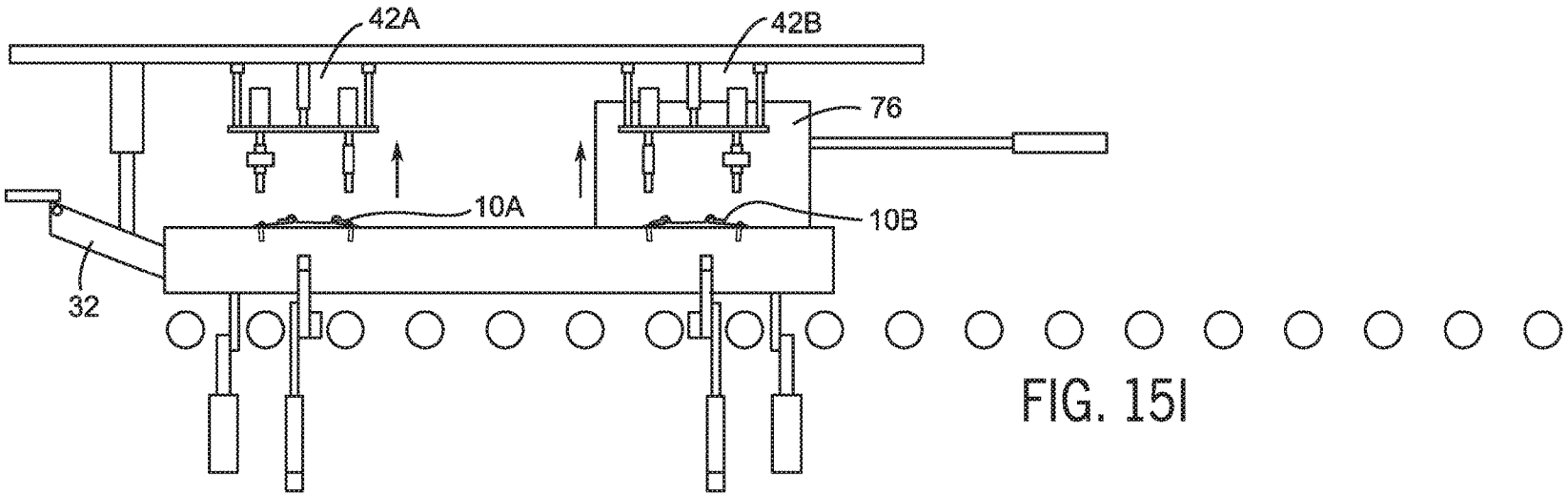
Figure 15K:
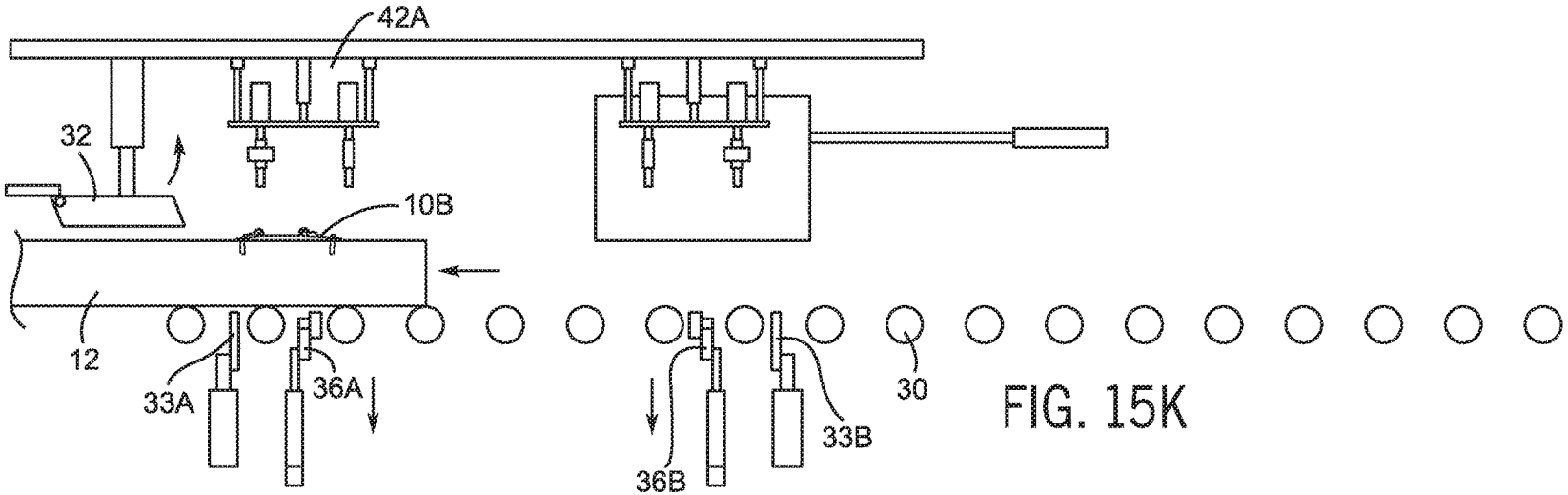
Figure 15J:
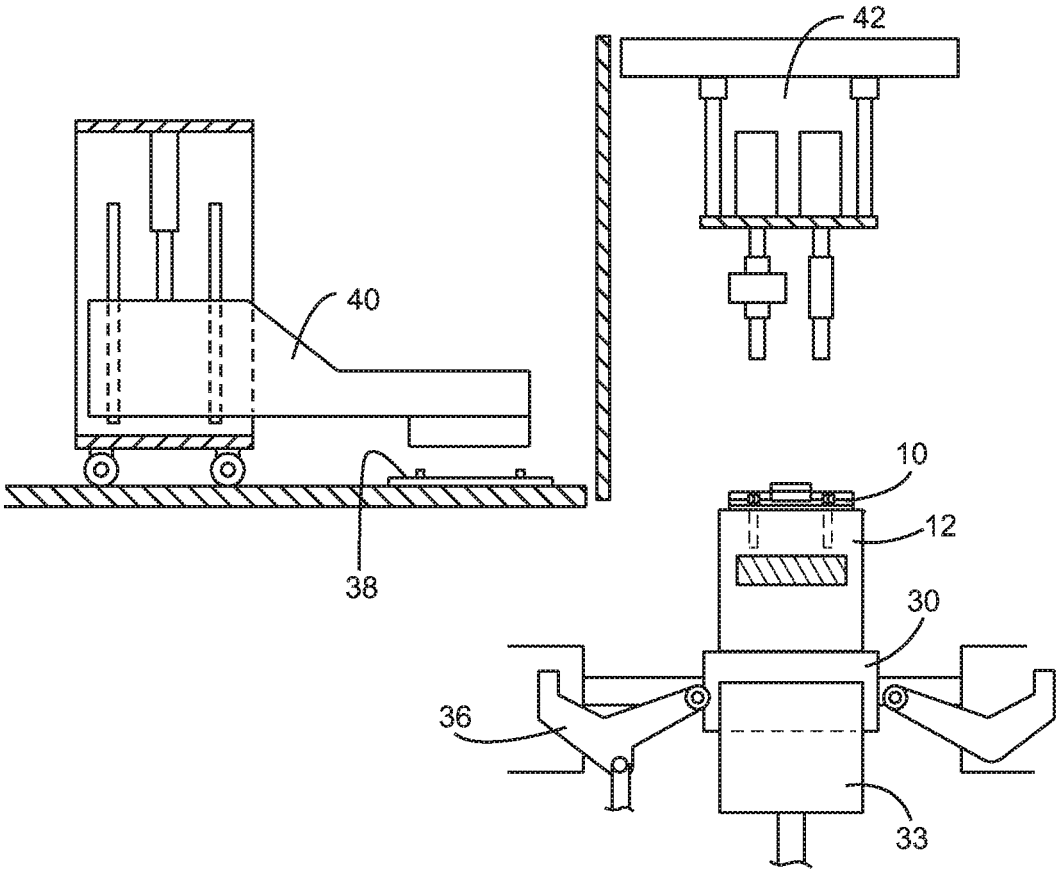

In FIG. 15I, the electromagnets have been deactivated and the holding presses have been lifted and moved out of the way. In addition, the screw presses 42A, 42B are lifted. FIGS. 15K and 15J show the next step in the process in which the clamps 36A, 36B have been released, the end stop 32 has been lifted, the lifts 33A, 33B have been lowered, the railroad tie 12 is placed on the rollers 30, and the rollers 30 are turned on to transport the finished railroad tie 12 away from the plate attachment stations 22A, 22B. FIG. 15J shows the system in the same stage of operation as shown in FIG. 15K, but from a longitudinal perspective.

The invention has been described in connection with an exemplary embodiment of implementing the invention. Not all of the above described features are necessary for implementing the broader aspects of the invention. The following claims should be considered when determining whether a given method or machine falls within the scope of the patent.

What is claimed is:

1. A method of attaching a pair of tie plates to a wooden railroad tie such that the tie plates are aligned and in gauge, the method comprising the steps of:

providing a predrilled railroad tie;

providing a plating system having a first and second plate attachment station, each plate attachment station having a holding press with a foot to hold a tie plate on the predrilled railroad tie and a screw press to hold and fasten one or more screw spikes for each held railroad tie;

conveying the predrilled railroad tie into the plating system;

aligning a line end of the predrilled railroad tie in registration with a reference position in the plating station;

clamping the drilled railroad tie in the registered position such that a top surface of the predrilled railroad tie lies substantially in a horizontal plane;

placing a first tie plate and a second tie plate on the top surface of the predrilled railroad tie;

holding the first tie plate against the top surface of the predrilled railroad ties with the foot of the holding press in the first plate attachment station and holding the second tie plate against the top surface of the predrilled railroad ties with the foot of the holding press in the second plate attachment station, wherein the first and second tie plates are held in registration along the aligned, clamped railroad tie so that rails mounted in the tie plates are in gauge; and while the railroad tie is aligned and clamped and the first tie plate is held against the top surface of the railroad tie with the press foot of the first plate attachment station and the second tie plate is held against the top surface of the railroad tie with the press foot of the second plate attachment station, using the screw press in the first plate attachment station to screw one or more screw spikes and fasten the first tie plate to the top surface of the drilled railroad tie and using the screw press in the second plate attachment station to screw one or more screw spikes and fasten the second tie plate to the top surface of the drilled railroad tie; wherein the screw spikes are placed through screw holes in the respective tie plate and into the drilled holes in the top surface of the railroad ties prior to screwing the screw spikes to fasten the respective tie plates.

2. The method of claim 1 wherein the step of providing a predrilled railroad tie comprises the steps of:

providing a predrill system having a conveyor that moves in an x-direction;

placing a railroad tie on the conveyor with its length generally perpendicular to the x-direction and its line end facing a predetermined side;

conveying the railroad tie to a drilling station;

lifting the railroad tie from the conveyor once it has been conveyed to the drilling station;

aligning the line end of the lifted railroad tie in registration to a reference position in a y-direction which is parallel to the x-direction;

clamping the lifted railroad tie after it is aligned along the line end; and drilling screw holes in the top surface of the railroad tie for both tie plates while the railroad tie is clamped in the registered position in the drilling station.

3. The method of claim 1 further comprising the step of placing an elastomeric pad under each of the first and second tie plate before fastening the tie plate to the railroad tie.

4. The method of claim 1 wherein the plating system has:

a first staging plate for holding the first tie plate and holding press in the first plate attachment station picks up the first tie plate from the first staging plate and places the tie plate on the aligned and clamped predrilled railroad tie; and a second staging plate for holding the second tie plate and the holding press for the second plate attachment station picks up the second tie plate from the second staging plate and places the tie plate on the aligned and clamped predrilled railroad tie.

5. The method of claim 4 wherein the holding press in the first plate attachment station has an electromagnet that is controlled to lift and release the first tie plate as required, and the holding press in the second plate attachment station has an electromagnet that is controlled to lift and release the second tie plate as required.

6. The method of claim 4 wherein the staging plates each includes reference pins to hold the respective tie plate in alignment when it is lifted by the respective holding press.

7. The method of claim 1 wherein the press foot in the first plate attachment station is configured to nest within a rail channel of the first tie plate between a field side shoulder and an inside shoulder and the press foot in the first plate attachment station is also canted to complement the rail channel of the first tie plate when its rail channel is canted towards the inside, and the press foot in the second plate attachment station is configured to nest within a rail channel of the second tie plate between a field side shoulder and an inside shoulder and the press foot in the second plate attachment station is canted to complement the rail channel of the second tie plate when its rail channel is canted towards the inside.

8. The method of claim 1 wherein the position of powered sockets in the respective screw presses is set according to the position of screw holes in the respective tie plates.

9. The method of claim 1 wherein the steps of conveying the predrilled railroad tie into the first and second plate attachment stations and aligning a line end of the predrilled railroad tie in registration with a reference position in the plating system comprise: moving the predrilled railroad tie lengthwise into the plating system on driven rollers until the line end of the railroad tie encounters an end stop, lifting the railroad tie and clamping the railroad tie prior to fastening the first and second tie plates to the top surface of the railroad tie.

10. The method of claim 1 wherein the step of clamping the predrilled railroad tie in the registered position further comprises the use of two self-centering clamps that clamp the lateral sides of the railroad tie and an end clamp that pushes against the end of the railroad tie opposite its line end when the line end is abutting the end stop.

11. The method of claim 1 wherein the screw spikes are placed through the screw holes in the respective tie plate and in the drill holes in the top surface of the railroad tie individually by hand.

12. The method of claim 1 further comprising the steps of sensing when socket assemblies on the in the screw presses of the first and second plate attachment stations have move downward to a pre-selected depth when screwing screw spikes into the railroad tie, generating a respective signal in response thereto, and deactivating rotation of the respective screw sockets when the signal is received.

13. The method of claim 1 wherein each screw press includes multiple screw heads, a rotational actuator for each screw head and a linear actuator for lifting and lowering a mounting plate to which the screw heads and rotational actuators are mounted.

14. The method of claim 13 further comprising the steps of:

selecting an appropriate set-up template for the tie plates being attached to the railroad ties and positioning the screw heads according to the template.

15. The method of claim 2 wherein the drilling station includes a first drill press and a second drill press, and each drill press includes multiple drilling heads and bits, a rotational actuator for each drilling head and bit, and a linear actuator for lifting and lowering a mounting plate to which the drilling heads and bits and rotational actuators are mounted, and the method further comprises the steps of:

selecting an appropriate set-up template for the tie plates being attached to the railroad ties and positioning the drill bits according to the template.

16. The method of claim 2 wherein the step of clamping the railroad tie in the registered position in the drill station further comprises the use of two self-centering clamps that clamp the lateral sides of the railroad tie and an end clamp that pushes against the end of the railroad tie opposite its line end when the line end is abutting the end stop.

17. A plating system for attaching a pair of tie plates to a wooden railroad tie such that the tie plates are aligned and in gauge, the system comprising:

a conveyor for loading predrilled railroad ties one at a time into the plating system;

a lift for lifting a loaded railroad tie from the conveyor;

an end stop for a line end of a lifted railroad tie and an end clamp to push the opposite end of the railroad tie against the end stop;

a pair of self-centering lateral clamps for clamping the sides of the lifted railroad tie, wherein a top surface of the lifted railroad tie lies substantially in a horizontal plane when it is clamped between the end stop and end clamp and the with the self-centering lateral clamps;

a first and second plate attachment station, each plate attachment station having a holding press with a foot to hold a tie plate on the clamped railroad tie and a screw press to hold and fasten one or more screw spikes for each tie plate, wherein the tie plates are attached in gauge as measured from the line end of the railroad tie.

18. The plating system of claim 17 further comprising:

a first staging plate for holding the first tie plate prior to the holding press in the first plate attachment station picking up the first tie plate and placing the tie plate on the clamped predrilled railroad tie; and a second staging plate for holding the second tie plate prior to the holding press in the second plate attachment station picking up the second tie plate and placing the tie plate on the clamped predrilled railroad tie;

wherein the staging plates each include reference pins to hold the respective tie plate in alignment when it is lifted by the respective holding press.

19. The system of claim 17 wherein the holding press in the first plate attachment station has an electromagnet that is controlled to lift and release the first tie plate as required, and the holding press in the second plate attachment station has an electromagnet that is controlled to lift and release the second tie plate as required; and further wherein the press foot in the first plate attachment station is configured to nest within a rail channel of the first tie plate between a field side shoulder and an inside shoulder and the press foot in the first plate attachment station is canted to complement the rail channel of the first tie plate when its rail channel is canted towards the inside, and the press foot in the second plate attachment station is configured to nest within a rail channel of the second tie plate between a field side shoulder and an inside shoulder and the press foot in the second plate attachment station is canted to complement the rail channel of the second tie plate when its rail channel is canted towards the inside.

20. The system of claim 17 wherein each screw press includes multiple screw heads, a rotational actuator for each screw head and a linear actuator for lifting and lowering a mounting plate to which the screw heads and rotational actuators are mounted.

* * * * *